US011288988B2

(12) United States Patent
Du

(10) Patent No.: US 11,288,988 B2
(45) Date of Patent: Mar. 29, 2022

(54) DISPLAY CONTROL METHODS AND APPARATUSES

(71) Applicant: Beijing Zhigu Rui Tuo Tech Co., Ltd, Beijing (CN)

(72) Inventor: Lin Du, Beijing (CN)

(73) Assignee: BEIJING ZHIGU RUI TUO TECH CO., LTD, Beijing (CN)

( * ) Notice: Subject to any disclaimer, the term of this patent is extended or adjusted under 35 U.S.C. 154(b) by 137 days.

(21) Appl. No.: 15/170,214

(22) Filed: Jun. 1, 2016

(65) Prior Publication Data

US 2016/0358523 A1 Dec. 8, 2016

(30) Foreign Application Priority Data

Jun. 5, 2015 (CN) ..... 201510305629.1

(51) Int. Cl.
*G09G 3/00* (2006.01)
*G09G 3/34* (2006.01)

(52) U.S. Cl.
CPC ..... *G09G 3/003* (2013.01); *G09G 3/3406* (2013.01); *G09G 3/3433* (2013.01); *G09G 2340/0457* (2013.01)

(58) Field of Classification Search
None
See application file for complete search history.

(56) References Cited

U.S. PATENT DOCUMENTS

| | | | | |
|---|---|---|---|---|
| 5,499,138 | A | 3/1996 | Iba | |
| 5,764,319 | A | 6/1998 | Nishihara | |
| 7,359,120 | B1 | 4/2008 | Raymond et al. | |
| 2002/0008674 | A1* | 1/2002 | Son | H04N 13/363 345/4 |

(Continued)

FOREIGN PATENT DOCUMENTS

| | | | |
|---|---|---|---|
| CN | 1093181 | A | 10/1994 |
| CN | 1419787 | A | 5/2003 |

(Continued)

OTHER PUBLICATIONS

Office Action for Chinese Application Serial No. 201510305630.4 dated May 3, 2018 (English translation unavailable), 5 pages.

(Continued)

*Primary Examiner* — Benjamin X Casarez
(74) *Attorney, Agent, or Firm* — Amin, Turocy & Watson, LLP

(57) ABSTRACT

Various display control methods and apparatuses are provided. A method comprises changing a ratio of pixels distributed along two directions in each effective display region of at least one display unit of a display system, wherein light emitted by each pixel in the effective display region of each display unit in the at least one display unit is transmitted to a visual angle range by a lens corresponding to the display unit in the display system, and the two directions comprise a first direction and a second direction parallel with the display unit and orthogonal with each other;

(Continued)

and displaying a content to be displayed by the changed display system. Differentiated display of visual angle information of two mutual orthogonal different directions can be thereby realized.

48 Claims, 13 Drawing Sheets

(56) References Cited

U.S. PATENT DOCUMENTS

2003/0161040 A1* 8/2003 Ishii ..... G02B 27/2214 359/463
2004/0150583 A1* 8/2004 Fukushima ..... G02B 27/2214 345/6
2005/0264881 A1 12/2005 Takagi et al.
2007/0052729 A1 3/2007 Fukushima et al.
2007/0229495 A1* 10/2007 Ito ..... G09G 3/003 345/419
2008/0112056 A1 5/2008 Raymond et al.
2008/0204663 A1 8/2008 Balogh
2008/0218433 A1 9/2008 Hong et al.
2008/0224951 A1* 9/2008 Alberth ..... G06F 1/1601 345/55
2009/0079733 A1* 3/2009 Fukushima ..... H04N 13/0404 345/419
2009/0231698 A1 9/2009 Hashimoto et al.
2011/0242103 A1* 10/2011 Han ..... H04N 13/0022 345/419
2012/0019676 A1 1/2012 Foote
2012/0075166 A1 3/2012 Marti et al.
2012/0182292 A1* 7/2012 Shimoyama ..... G02B 27/0093 345/419
2012/0182326 A1* 7/2012 Moore ..... G02B 27/0172 345/690
2012/0188245 A1* 7/2012 Hyatt ..... G02B 27/0172 345/428
2013/0010263 A1 1/2013 Wang et al.
2013/0033748 A1 2/2013 Mathai et al.
2013/0182319 A1* 7/2013 Chung ..... G02B 27/2214 359/463
2013/0229336 A1* 9/2013 Shimoyama ..... G06F 3/005 345/156
2013/0258451 A1 10/2013 El-Ghoroury et al.
2013/0335459 A1 12/2013 Tokoo et al.
2014/0055693 A1* 2/2014 Nam ..... G02B 27/22 349/15
2014/0078268 A1* 3/2014 Watanabe ..... G02B 27/2214 348/54
2014/0085719 A1 3/2014 Hamagishi et al.
2014/0168395 A1 6/2014 Iwane
2014/0225940 A1* 8/2014 Nakagawa ..... G09G 3/3607 345/690
2014/0293759 A1 10/2014 Taff et al.
2014/0300711 A1* 10/2014 Kroon ..... H04N 13/302 348/51
2014/0300714 A1* 10/2014 Muller ..... H04N 13/0404 348/54
2014/0340390 A1 11/2014 Lanman et al.
2014/0347361 A1 11/2014 Alpaslan et al.
2015/0287158 A1* 10/2015 Cerny ..... G06F 3/013 345/553
2015/0304644 A1 10/2015 Kim et al.
2015/0334379 A1* 11/2015 Du ..... H04N 13/0413 348/51
2016/0021367 A1* 1/2016 Yoon ..... H04N 13/324 348/59
2016/0291336 A1 10/2016 Yoshida
2016/0357494 A1 12/2016 Du
2016/0358522 A1 12/2016 Du
2016/0370588 A1 12/2016 Parker et al.
2017/0059960 A1 3/2017 Shi et al.
2017/0171533 A1 6/2017 Benitez et al.
2017/0264891 A1 9/2017 Iwasaki
2017/0315367 A1 11/2017 Maruyama et al.
2017/0353717 A1* 12/2017 Zhou ..... H04N 13/0497
2017/0372683 A1* 12/2017 Du ..... G09G 5/38
2018/0033356 A1* 2/2018 Zhou ..... G09G 3/007

FOREIGN PATENT DOCUMENTS

CN 1472592 A 2/2004
CN 1717929 A 1/2006
CN 1925628 A 3/2007
CN 1954257 A 4/2007
CN 101154329 A 4/2008
CN 101394572 A 3/2009
CN 102186044 A 9/2011
CN 102193196 A 9/2011
CN 102332090 A 1/2012
CN 202424936 U 9/2012
CN 102880337 A 1/2013
CN 102971660 A 3/2013
CN 103348687 A 10/2013
CN 103454806 A 12/2013
CN 103530845 A 1/2014
CN 103534745 A 1/2014
CN 103607553 A 2/2014
CN 103795997 A 5/2014
CN 104159025 A 11/2014
CN 104423051 A 3/2015
CN 104469343 A 3/2015
CN 104469344 A 3/2015
CN 104519347 A 4/2015
CN 104537975 A * 4/2015 ..... G09G 3/007
TW 201018994 A 5/2010
WO 01/56298 A1 8/2001
WO 2014133481 9/2014

OTHER PUBLICATIONS

Office Action for Chinese Application Serial No. 201510305630.4 dated May 3, 2018, 9 pages (with translation).
Office Action dated Apr. 19, 2018 for U.S. Appl. No. 15/170,245, 58 pages.
Office Action dated Apr. 19, 2018 for U.S. Appl. No. 15/170,308, 82 pages.
Chinese Office Action dated Nov. 21, 2018 for Chinese Patent Application No. 201510303176.9, 16 pages (including translation).
Office Action dated Nov. 29, 2018 for U.S. Appl. No. 15/170,245, 74 pages.
Office Action dated Nov. 29, 2018 for U.S. Appl. No. 15/170,308, 90 pages.
Non-Final Office Action received for U.S. Appl. No. 15/170,245 dated Jun. 13, 2019, 62 pages.
Non-Final Office Action received for U.S. Appl. No. 15/170,308 dated May 30, 2019, 129 pages.
Second Office Action received for Chinese Patent Application Serial No. 201510305629.1 dated Jul. 30, 2019, 18 pages (including English Translation).
Second Office Action received for Chinese Patent Application Serial No. 201510303176.9 dated May 20, 2019, 8 pages.
Final Office Action received for U.S. Appl. No. 15/170,245 dated Dec. 26, 2019, 74 pages.
Final Office Action received for U.S. Appl. No. 15/170,308 dated Dec. 11, 2019, 141 pages.
Non-Final Office Action received for U.S. Appl. No. 15/170,245 dated May 27, 2020, 56 pages.
Non-Final Office Action received for U.S. Appl. No. 15/170,308 dated May 27, 2020, 150 pages.
Chinese Office Action dated Jan. 9, 2019 for Chinese Patent Application No. 201510305629.1, 14 pages (including translation).

* cited by examiner

DISPLAY CONTROL METHODS AND APPARATUSES

RELATED APPLICATION

The present application claims the benefit of priority to Chinese Patent Application No. 201510305629.1, filed on Jun. 5, 2015, and entitled "Display Control Methods and Apparatuses", which application is hereby incorporated into the present application by reference herein in its entirety.

TECHNICAL FIELD

The present application relates to the technical field of display, and, for example, to various display control methods and apparatuses.

BACKGROUND

A traditional display technology is inadequate on an aspect of meeting of diversified application requirements of a user on a display image. Along with more and more individualized requirements of the user on the display image, a traditional display technology-based improvement technology continuously gets rid of the stale and brings forth the fresh, for example, technologies such as a display array and light field display can realize relatively flexible display effects such as light field reconfiguration and vision correction display by similar hardware structures of the traditional display technology.

SUMMARY

The following gives brief description of the present application to provide basic understandings on some aspects of the present application. It should be understand that the description is not an exhaustion description of the present application. It intends to determine neither key or important parts of the present application or a scope of the present application, and merely aims to give some concepts in a simplifying manner, thereby serving as a preorder of the more detailed description discussed later.

The present application provides various display control methods and apparatuses.

On a first aspect, an example embodiment of the present application provides a display control method, comprising:

changing a ratio of pixels distributed along two directions in each effective display region of at least one display unit of a display system, wherein light emitted by each pixel in the effective display region of each display unit in the at least one display unit is transmitted to a visual angle range by a lens corresponding to the display unit in the display system, and the two directions comprise a first direction and a second direction parallel with the display unit and orthogonal with each other; and displaying a content to be displayed by the changed display system.

On a second aspect, an example embodiment of the present application provides a display control apparatus, comprising a pixel ratio changing module, configured to change a ratio of pixels distributed along two directions in each effective display region of at least one display unit of a display system, wherein light emitted by each pixel in the effective display region of each display unit in the at least one display unit is transmitted to a visual angle range by a lens corresponding to the display unit in the display system, and the two directions comprise a first direction and a second direction parallel with the display unit and orthogonal with each other; and a display control module, configured to display a content to be displayed by the changed display system.

On a third aspect, an example embodiment of the present application provides another display control apparatus, comprising:

a processor, a communication interface, a memory and a communication bus; the processor, the communication interface and the memory finish mutual communication by the communication bus;

the memory is configured to store at least one command; the at least one command enables the processor to execute following operations:

changing a ratio of pixels distributed along two directions in each effective display region of at least one display unit of a display system, wherein light emitted by each pixel in the effective display region of each display unit in the at least one display unit is transmitted to a visual angle range by a lens corresponding to the display unit in the display system, and the two directions comprise a first direction and a second direction parallel with the display unit and orthogonal with each other; and displaying a content to be displayed by the changed display system.

According to the example embodiments of the present application, a ratio of pixels distributed along the first direction and the second direction in each effective display region of at least one display unit is changed to cause that in each effective display region of the at least one display unit, a quantity of pixels distributed along the first direction and a quantity of pixels distributed along the second direction are different, a pixel ratio of the two is not equal to 1, thus, by using the display system comprising the display unit with the changed pixel ratio for content display, a proportion of practically displayed parallax information of the at least one display unit respectively displayed in the first direction and the second direction is changed, and differentiated display of the visual angle information in different directions is realized to cause the practically displayed content to present differentiated angle resolutions of different directions, thereby better meeting diversified practical application requirements.

By following detailed description on optional embodiments of the present application in combination with drawings, these and other aspects of the present application will be more obvious.

BRIEF DESCRIPTION OF THE DRAWINGS

The present application will be better understood in reference to the description given in combination with the drawings, same or similar drawing marks used in all drawings to denote same or similar parts. The drawings together with the detailed description are contained in the present description and form a part of the present description, and are used for further exampling to describe the optional embodiments of the present application and explain principles and advantages of the present application. In the drawings.

Figure 1:
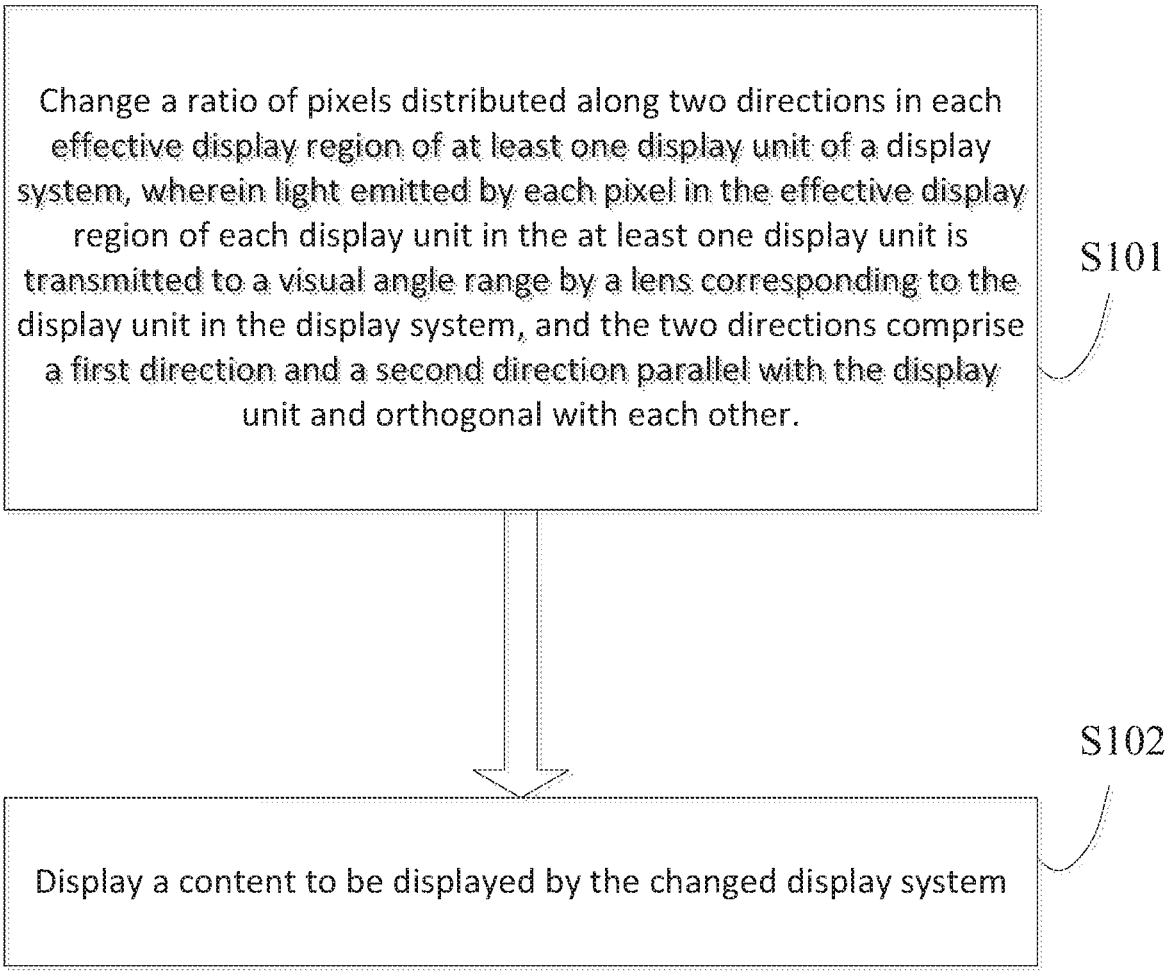
FIG. 1 is a flow chart of a display control method according to an example embodiment of the present application.

Those skilled should understand that elements in the drawings are merely for the purpose of simplicity and clearness and are not drawn in proportion. For example, sizes of some elements in the drawings are amplified relative to other elements, to help to improve understandings on the embodiments of the present application.

DETAILED DESCRIPTION

The following will describe exemplary embodiments of the present application in detail in combination with the drawings. For the purpose of clearness and briefness, not all characteristics of practical embodiments are described in the description. However, it should be understood that in a process of developing such practical embodiments, many decisions specific to the embodiments are to be made to facilitate developers to realize specific targets, for example, conditions related to the system and business, and those conditions may be changed along with difference of the embodiments.

In addition, it also should be indicated that in order to prevent unnecessary details from blurring the present application, only apparatus structures and/or processing steps tightly related to solutions according to the present application are described in the drawings and description, and presentation and description of parts and processing known by those common skilled in the art and unrelated to the present application are omitted.

Example embodiments of the present application are described in further detail below with reference to the drawings (in which like elements are denoted by like reference numerals) and corresponding description. The following embodiments are intended to describe the present application, but not to limit the scope of the present application.

A person of ordinary skill in the art should understand that the terms "first" and "second" in the present application merely intend to differentiate different steps, devices or modules, and present neither any specific technical meaning nor necessary logic sequence among the different steps, devices or modules.

FIG. 1 is a flow chart of a display control method according to an embodiment of the present application. An execution body of a display control method according to the embodiment of the present application can be some display control apparatus, the display control apparatus can conduct display control of content by executing the display control method in an application process comprising but not limited to content presentation, video display, etc. For example, the display control apparatus can be some or one independent part, which matches and communicates with a display system comprising display unit; or the display control apparatus can be integrated in the display system comprising the display unit as certain function module. Specifically, as shown in FIG. 1, the display control method according to an embodiment of the present application comprises:

S101: Change a ratio of pixels distributed along two directions in each effective display region of at least one display unit of a display system, wherein light emitted by each pixel in the effective display region of each display unit in the at least one display unit is transmitted to a visual angle range by a lens corresponding to the display unit in the display system, and the two directions comprise a first direction and a second direction parallel with the display unit and orthogonal with each other.

S102: Display a content to be displayed by the changed display system.

For a display system with functions such as light field reconfiguration or vision correction display, generally not all pixels of each display unit participate in essence display of the content; light emitted from partial pixels in the display unit is transmitted to certain visual angle range of the display system by a lens corresponding to the display unit, and these pixels are positioned in an effective region of the display unit; light emitted by other partial pixels of the display unit cannot be transmitted to the visual angle range even being redirected by the lens corresponding to the display unit, and these pixels are positioned in regions outside the effective region of the display unit, which are called as ineffective regions.

In an example embodiment of the present application, the display unit is a square, the effective region of the display unit is a round region in the square, other regions besides the round region of the display unit are ineffective regions, and light emitted by each pixel in the round region (effective region) can be transmitted to a visual angle range of the display system by a lens corresponding to the display unit. Quantities of the pixels distributed along different directions in the effective region of the display unit are equal, a ratio (pixel ratio) of the quantities of pixels distributed along different directions in the effective region is 1, for example, the quantities of the pixels distributed along two orthogonal directions (first direction and second direction) vertical to a normal in the effective region are equal, a pixel ratio is equal to 1, the effective region provides quantities of the pixels of same proportions for the visual angle information display of the two directions, and proportions of amounts of information of the two directions in the visual angle information displayed by the effective region are equal.

However, in some cases, the visual angle information of different directions has different meanings and/or actions. For example, in a scene using the display system for light field reconfiguration, since human eyes are more sensitive to display details in a horizontal direction, expect to obtain a higher angle resolution in the horizontal direction and are insensitive to the display details in a vertical direction, etc. By adopting a traditional manner for content display, visual angle information of the same proportion of different directions can be obtained, and the display manner cannot make full use of a pixel resource of the display unit to meet differentiated display requirements on the visual angle information proportion of different directions.

According to one or more example embodiments of the present application, a ratio of pixels distributed along the first direction and the second direction in each effective display region of at least one display unit is changed to cause that in each effective display region of the at least one display unit, a quantity of the pixels distributed along the first direction and a quantity of the pixels distributed along the second direction are different, a pixel ratio of the two is not equal to 1, thus, by using the display system comprising the display unit with a changed pixel ratio for content display, a proportion of practically displayed parallax information of the at least one display unit respectively displayed in the first direction and the second direction is changed, differentiated display of the visual angle information of different directions is realized to cause the practically displayed content to present differentiated angle resolutions in different directions, thereby better meeting diversified practical application requirements.

A display system capable of being applied by the technical solution according to the embodiment of the present application has a characteristic of adopting a plurality of pixels to display visual information of different directions of a same object in the content to be displayed, according to difference of the display systems, the pixels for displaying visual information of different directions of the same object in the content to be displayed can be concentrated and distributed in certain display unit, or dispersed and distributed in different display units, etc. The at least one display unit comprises situations of a display unit and a plurality of display units. Optionally, if the pixels for displaying visual information of different directions of the same object in the content to be displayed are concentrated and distributed in certain display unit, a ratio of the pixels along two orthogonal directions of the display unit can be changed, thereby changing the proportions of parallax information practically respectively displayed by the display unit in the first direction and the second direction, and realizing differentiated display of the display unit for the visual angle information in different directions. Or, optionally, if the pixels for displaying visual information of different directions of the same object in the content to be displayed are concentrated and distributed in a plurality of display units, the display units can be determined to change a pixel ratio along two orthogonal directions of each of the display units, thereby changing the proportions of parallax information practically respectively displayed in the first direction and the second direction by each of the display units, and realizing differentiated display of the display unit for the visual angle information in different directions. Or, a pixel ratio along the two directions of each display unit in the display system can be changed to realize the differentiated display of each display for the visual angle information of different directions.

Figure 2:
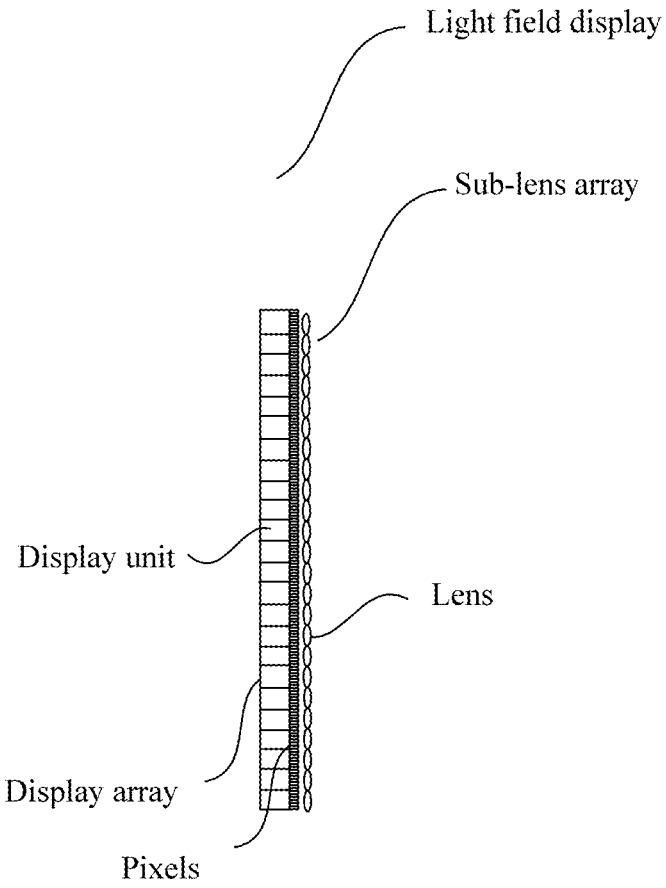
FIG. 2 is a structural schematic diagram of a light field display according to an example embodiment of the present application.

Optionally, the display system comprises a light field display, as shown in FIG. 2, the light field display comprises a display array and a sub-lens array, which are arranged in sequence, the sub-lens array comprises a plurality of lens in array distribution, and the display array comprises a plurality of display units in array distribution. In an optional realizing manner for content display based on the light field display, the multidirectional visual angle information of at least one object in the content to be displayed is respectively displayed by the pixels of the one of the at least one display unit, in other words, the multidirectional visual angle information of certain object in the content to be displayed is displayed by the pixels of the same display unit. In another optional realizing manner for content display based on the light field display, the multifunctional visual angle information of at least one object in the content is displayed by at least two of the at least one display unit, in other words, the multifunctional visual angle information of at least one object in the content is displayed by at least two display units, and practically displayed parts of the at least two display units have overlapping of certain extent. The light field display based on any foregoing realizing display manner can realize display effects of light field reconfiguration, vision correction display, etc., and light transmitted by each lens of the sub-lens array at least contains the multi-visual angle information of certain object. In the solution, by changing a ratio of the pixels along two orthogonal directions of the at least one display unit of the light field display, a proportion of respectively practically displayed parallax information of the at least one display unit in the first direction and the second direction can be changed, and differentiated display of the visual angle information in different directions is realized to cause the practically displayed content to present differentiated angle resolutions in different directions, thereby better meeting diversified practical application requirements.

Figure 3:
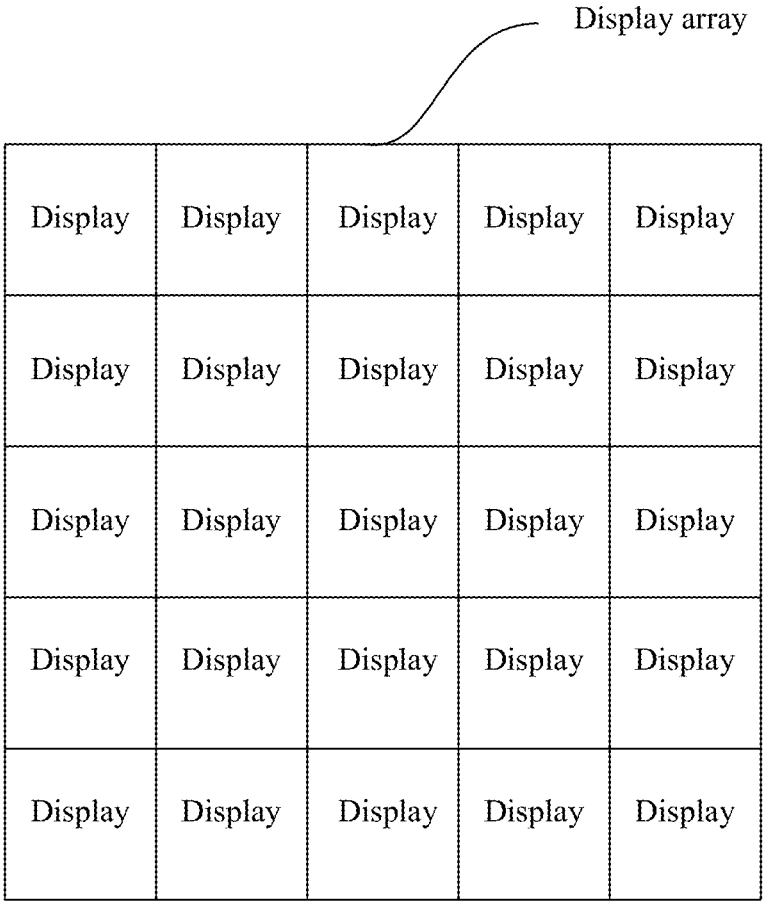
FIG. 3 is a structural schematic diagram of a display array according to an example embodiment of the present application.

Optionally, the display system comprises a display array, as shown in FIG. 3, the display array comprises a plurality of displays in array distribution, and the display comprises one display unit and one lens arranged in sequence. In a realizing manner of for content display based on the display array, the multidirectional visual angle information of certain object the content to be displayed is displayed by each display unit of the displays, and light of each display unit is redirected by each corresponding lens and reconfigured to a light field comprising the multi-visual angle information in a space. In the solution, by changing the pixel ratio of each of the display units of the display array along two orthogonal directions, a proportion of respectively practically displayed parallax information of the display units in the first direction and the second direction can be changed, and differentiated display of the multidirectional visual angle information in different directions is realized to cause the practically displayed content to present differentiated angle resolutions of different directions, thereby better meeting diversified practical application requirements.

In an example embodiment according to the present application, a specific realizing manner of changing a ratio of pixels distributed along two directions in each effective display region of the at least one display unit of one display system along two directions is very flexible and is not limited by the present application.

(1) Optionally, changing a ratio of pixels distributed along two directions in each effective display region of at least one display unit of a display system comprises: adjusting pixel distribution of the at least one display unit to change a ratio of the pixels along two directions in each effective display region of the at least one display unit.

In the example embodiment, the at least one display unit of the display system comprises a plurality of pixels in adjustable distribution, for example, intervals between partial pixels are adjusted by controlling at least local deformation of the display unit, thereby changing pixel distribution in the display unit. For example, in a practical application process, a display part of the display system can be a whole, the display part can be divided into a plurality of display regions, each display region corresponds to a lens in the display system, the display region is then the display unit according to the embodiment of the present application, pixel distribution is adjustable, light emitted by at least partial pixels of the display unit is transmitted to the visual angle range by a lens corresponding to the display unit, to cause a user to see corresponding light in the visual angle range, that is, the light entering eyes of the user images at funduses of the user; or, the display part of the display system can also comprise a plurality of units which are in array distribution, independent from one another and adjustable in distribution, and the display units and the lenses in the display system are in corresponding arrangement. The display units are adjustable in pixel distribution, and a specific structure and form of the device are not limited.

For example, the display unit can be a flexible display unit, the flexible display unit is already applied in some display devices, and according to the present application, the flexible display unit can be telescopic and deformed to some extent by actions such as an external force, thereby changing pixel distribution of the flexible display unit.

For another example, the display unit can comprise a plurality of pixels in array distribution, at least two pixels are connected by an elastic part or a controllable deforming material part (such as a photo-induced deforming material part, a magnetic-induced deforming material part, a dielectric material part, etc.), to form an integral display surface. By acting the deformable part with actions such as an external force or external field, deformation of corresponding connecting parts can be controlled to achieve the aims of adjusting the intervals between at least two pixels and changing pixel distribution of the display unit.

It can be understood that according to requirements of practical application, the display units and flexible display units in array distribution can be combined for use to form a display unit adjustable in pixel distribution. In a case that the displays serves as a whole, the display and the display unit can have the same or similar structure which is not repeated herein.

The solution makes full use of the characteristic that the pixel distribution of the display unit is adjustable, the pixel distribution of the display unit is adjusted to cause that in the effective region of the display unit, intervals of the pixels distributed along the first direction and intervals of the pixels distributed along the second direction are different, that is to say, by adjusting the pixel distribution of the display unit, quantities of the pixels distributed along the first direction and the second direction in the effective region of the display unit are different, a pixel ratio is not equal to 1, thus, by the display system comprising the display unit with adjusted pixel distribution for content display, a proportion of practically displayed parallax information of the display unit in the first direction and the second direction can be changed, and differentiated display of the multidirectional visual angle information of different directions is realized to cause the practically displayed content to present differentiated angle resolutions in different directions, thereby better meeting diversified practical application requirements.

A pixel distribution characteristic of the effective region with the adjusted pixel distribution relates to an adjusting manner of the pixel distribution of the display unit, the pixel distribution of the display unit can be flexibly adjusted, for example, the at least one display unit can be controlled to be deformed to cause the quantity of pixels distributed along the first direction in the effective region of the at least one display unit to be increased, and/or the quantity of pixels distributed along the second direction to be reduced, to cause a ratio of the pixels distributed along the two directions of the effective region with the adjusted pixel distribution to meet practical application requirements. For example, intervals of the pixels distributed along certain direction (for example the first direction and the second direction) in the effective region can be at least reduced to increase the quantity of pixels distributed along the direction in the effective region; and/or, intervals of the pixels distributed along certain direction (for example the first direction and the second direction) in the effective region can be increased to reduce the quantity of the pixels distributed along the direction in the effective region, etc. Pixel distribution characteristics of the effective region possibly generated after the pixel distribution of the display unit is adjusted are described by examples.

In one optional situation, the display unit is controlled to be deformed to reduce the intervals of the pixels distributed along the first direction in the effective region, thereby increasing the quantity of pixels distributed along the first direction in the effective region, while the quantity of pixels distributed along the second direction is unchanged, thereby changing a ratio of the pixels distributed along two directions in the effective region. The situation can increase the visual information display amount of the first direction and realize the differentiated display of the visual information in the two directions. In addition, the display unit comprises a plurality of pixels in array distribution, generally, the effective region comprises partial pixels of the display unit, that is to say, the pixels in ineffective regions outside the effective region of the display unit do not practically record light information in an image display process, thereby causing the pixels of the display units to not be fully used; due to the situation, the display unit with adjusted pixel distribution can increase the pixels distributed along the first direction in the effective region, and a proportion of ineffective pixels of the display unit is reduced, thereby improving a practical use ratio of the pixels of the display unit.

In another optional situation, the display unit is controlled to be deformed to increase the intervals of the pixels distributed along the second direction in the effective region, thereby reducing the quantity of the pixels distributed along the second direction in the effective region, while the quantity of the pixels distributed along the first direction is unchanged, thereby changing a ratio of the pixels distributed along the two directions in the effective region. The situation can reduce the visual information display amount of the second direction, differentiated display of the visual information of the two directions is realized, output of the visual information and processing data volume in the section direction can be reduced, and in scenes with low attention or demand quantity for the visual information of the second direction, the situation can save the resource required for processing the visual information of the second direction, and improve the actual use ratio of the resource.

Figure 4A:
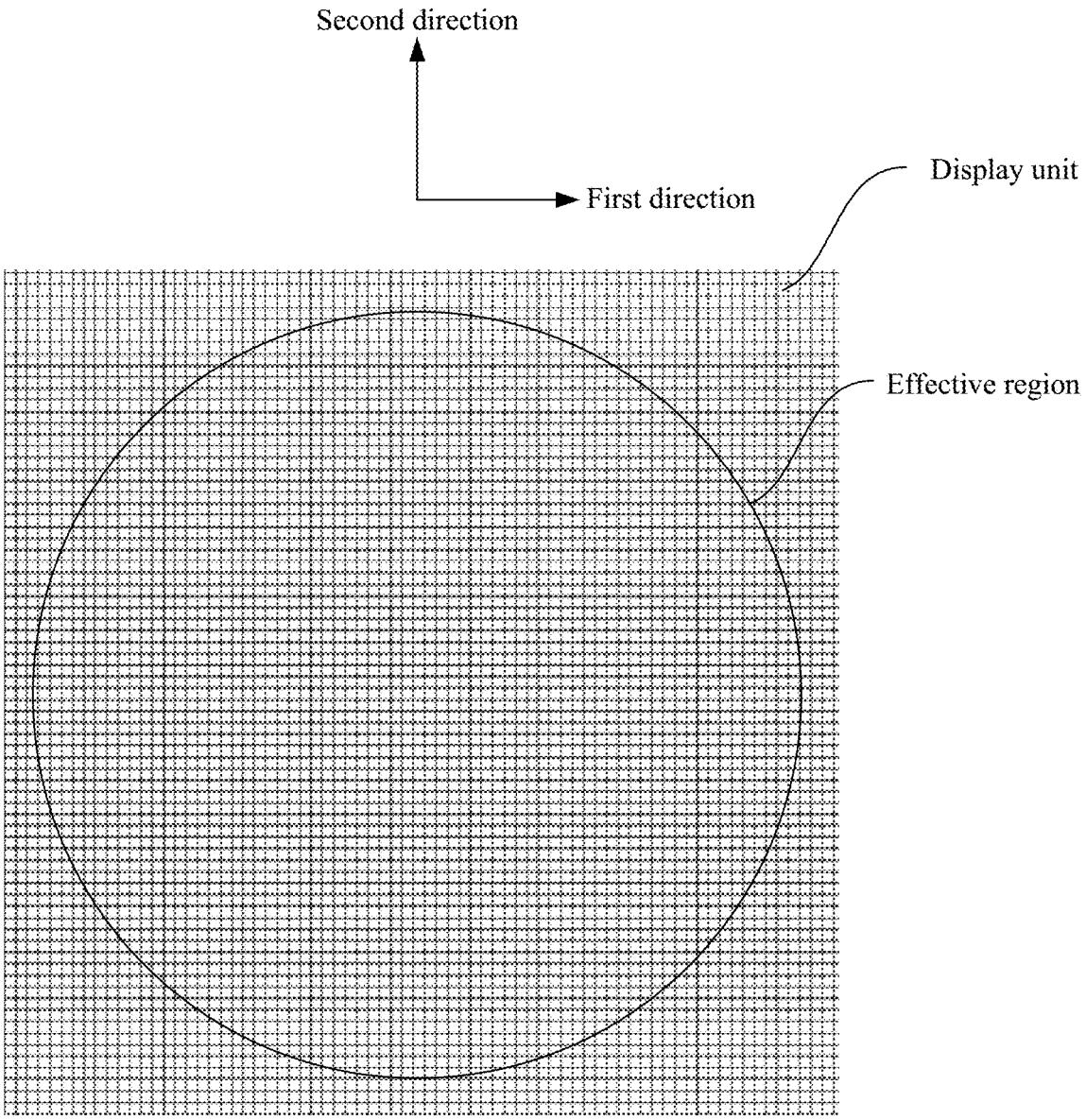
FIG. 4*a* is a pixel distribution illustration of a display unit before change of a pixel ratio according to an example embodiment of the present application.
Figure 4B:
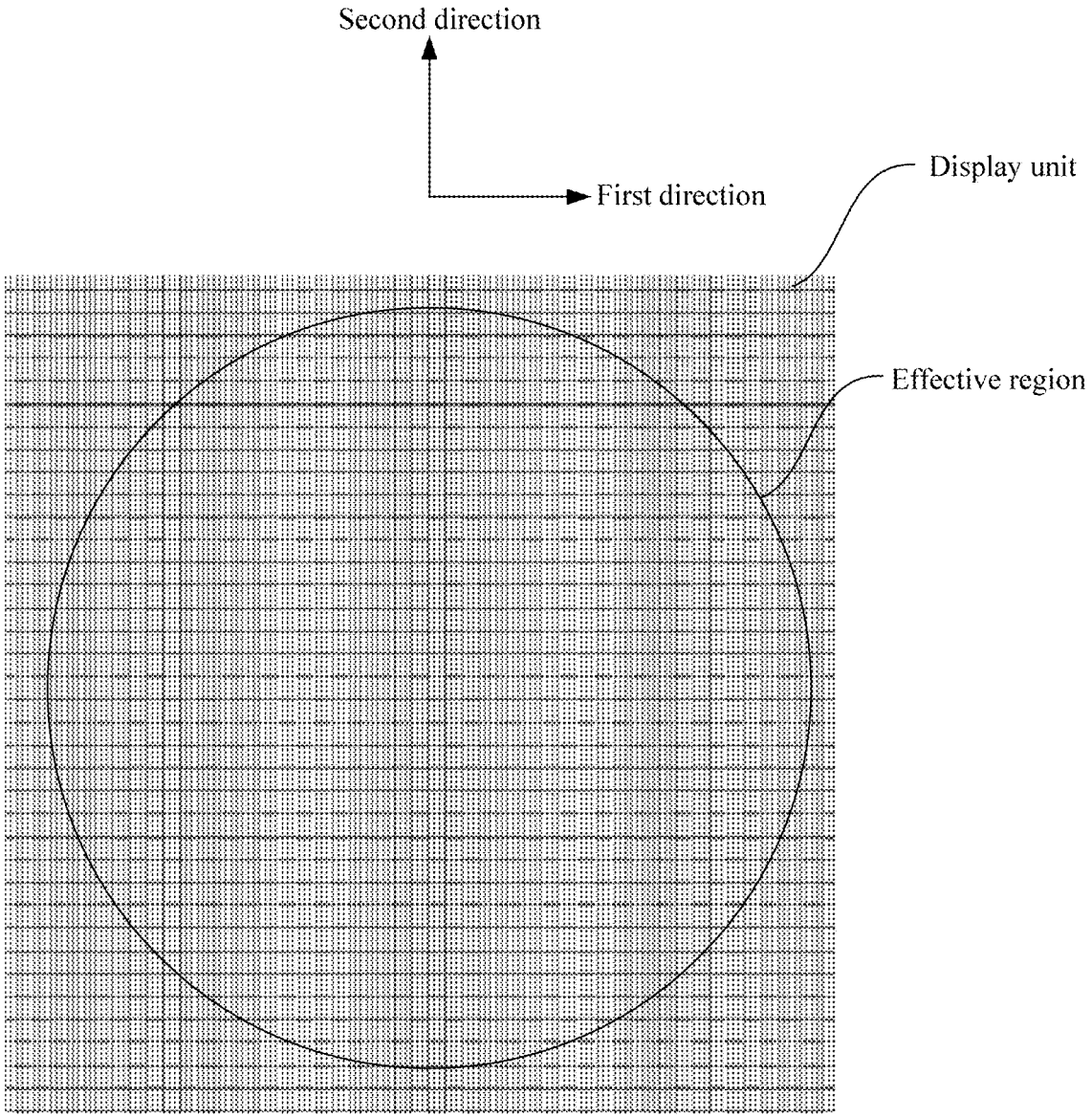
FIG. 4*b* is a pixel distribution illustration of a display unit after change of a pixel ratio according to an example embodiment of the present application.

In further optional situation, the display unit is controlled to be deformed to reduce the intervals of the pixels distributed along the first direction in the effective region and increase the intervals of the pixels distributed along the second direction in the effective region, thereby increasing the quantity of the pixels distributed along the first direction in the effective region, and reducing the quantity of the pixels distributed along the second direction, therefore, a ratio of the pixels distributed along the two directions in the effective region is changed. A case that the first direction is the horizontal direction parallel with certain display unit and the second direction is the vertical direction parallel with the display unit is taken as an example for describing the adjusting of the pixel distribution of the display unit. As shown in FIG. 4*a*, before the adjusting of the pixel distribution of the display unit, the pixels of the display unit are uniformly distributed, and a ratio of the pixels distributed along the first direction and the second direction is equal to 1. After the adjusting of the pixel distribution of the display unit, as shown in FIG. 4*b*, the pixels of the display unit are not uniformly distributed, the quantity of the pixels distributed along the first direction is increased and dense, and the quantity of pixels distributed along the second direction is reduced increased and is. The effective region is usually certain round region taking a circle center of the display unit as a center, corresponding to a situation as shown in FIG. 4*a* (before adjusting of the pixel distribution), a ratio of the pixels distributed along the horizontal direction and the vertical direction in the effective region of the display unit is equal to 1, corresponding to a situation as shown in FIG. 4*b* (after adjusting of pixel distribution), a ratio of pixels distributed along the horizontal direction and the vertical direction in the effective region of the display unit is larger than 1, namely the pixel proportion distributed in the horizontal direction is larger than that in the vertical direction. It can be seen that by adjusting the pixel distribution of the display unit, distribution of pixels in different directions in the effective region of the display unit is changed, particularly, the quantity of the pixels distributed along the horizontal direction and the quantity of the pixels distributed along the vertical direction in the effective region are different to cause a ratio of the pixels distributed along two directions in the effective region to be not equal to 1, thus, by the display system comprising the display system with the adjusted pixel distribution for content display, the proportions of visual angle information along the horizontal and vertical directions in the content practically displayed in the display unit are different, thereby realizing the differentiated display of the visual angle information of different directions, causing the practically displayed content to present a display effect of differentiated angle resolution such as a higher angle resolution in the horizontal direction and a lower angle resolution in the vertical direction.

An optional situation further comprises that in the display unit with the adjusted pixel distribution, the quantities of the pixels distributed along the two directions in the effective region are both increased but different in increment, thereby leading to a change of a ratio of the pixels distributed along the two directions or, an optional situation further comprises that in the display unit with the adjusted pixel distribution, the quantities of the pixels distributed along the two directions in the effective region are both reduced but different in increment, thereby leading to a change of a ratio of the pixels distributed along the two directions, etc., thus realizing the differentiated display of the visual information of the two directions by changing the ratio of the pixels.

Adjusting of the pixel distribution of the display unit can change pixel distribution in the effective region of the display unit, while the pixel quantity capable of being practically changed in the effective region relates to the pixel quantity and relative positions of the display units.

Figure 5:
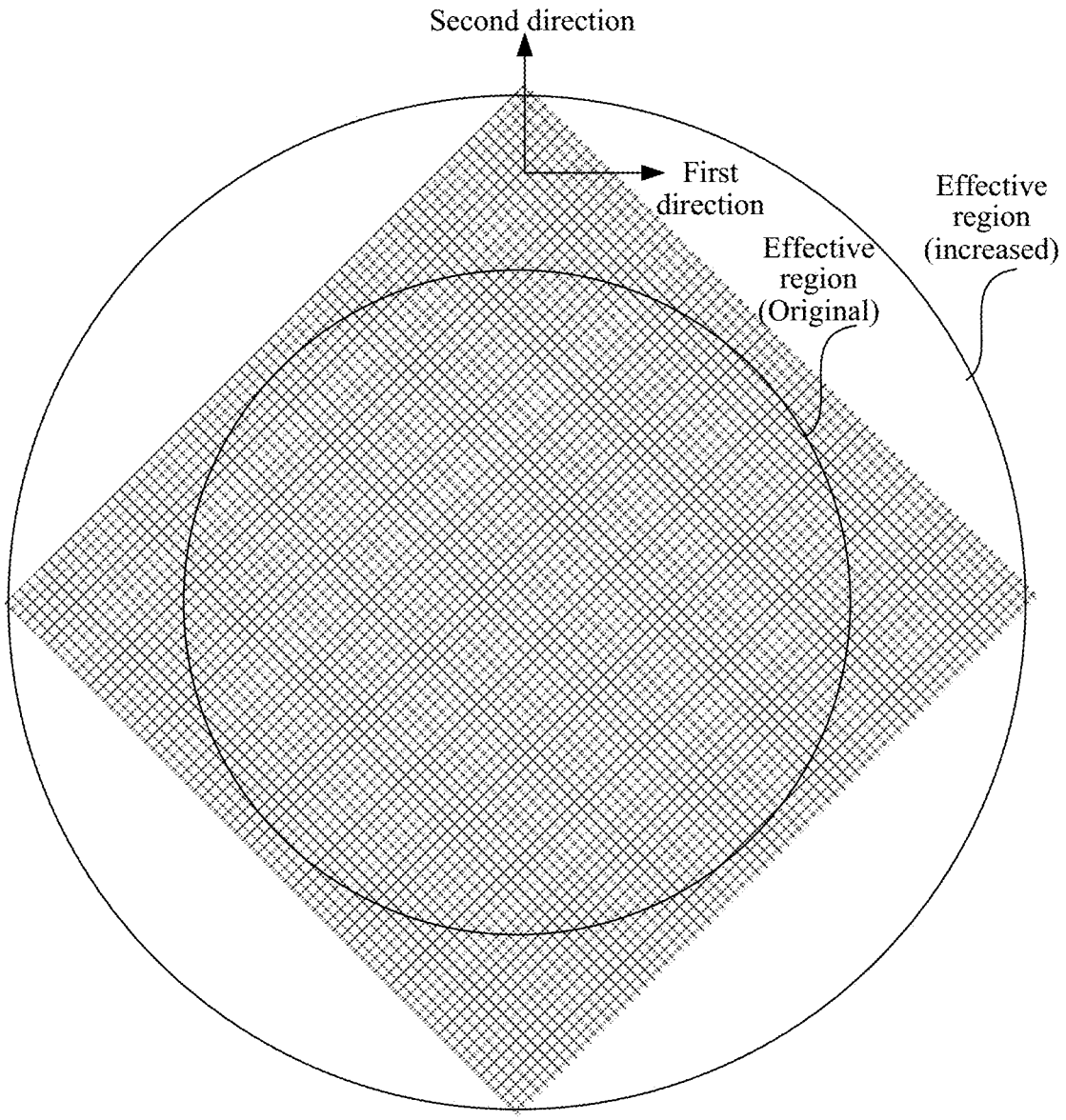
FIG. 5 is a rotating illustration of a display unit according to an example embodiment of the present application.

Optionally, before the displaying the image to be shot by the display system, the method further comprises: causing the at least one display unit to rotate around a normal direction thereof to cause the quantity of pixels distributed along the first direction of the at least one display unit to be increased. For example, as shown in FIG. 5, the display unit is square, the display unit can be rotated by 45 degrees around a normal direction thereof to cause the quantity of the pixels distributed along the first direction to be increased, thereby changing a controllable room of the quantity of the pixels distributed along the first direction in the effective region to be increased by controlling the display unit to be deformed, being favorable for adjusting more pixels distributed along the first direction in the existing pixels of the display unit into the effective region, and further being favorable for increasing a proportion of the visual information of the first direction comprised in the content displayed by the display unit, realizing the differentiated display of the visual information of different directions, and improving a practical use ratio of the resource as much as possible. It should be indicated that the operation of rotating the display unit can be performed before the adjusting of the pixel distribution of the display unit or after the adjusting of the pixel distribution of the display unit, and a realizing manner is very flexible and is not limited by the embodiment of the present application.

Optionally, before the displaying the content by the adjusted display system, each effective region of the at least one display unit can be increased, the solution can improve a practical use ratio of the pixels of the display unit, and changes a controllable room of the quantity of the pixels distributed along the first direction in the effective region by controlling the display unit to be deformed, thereby being more favorable for realizing differentiated visual information display of different directions.

Figure 6:
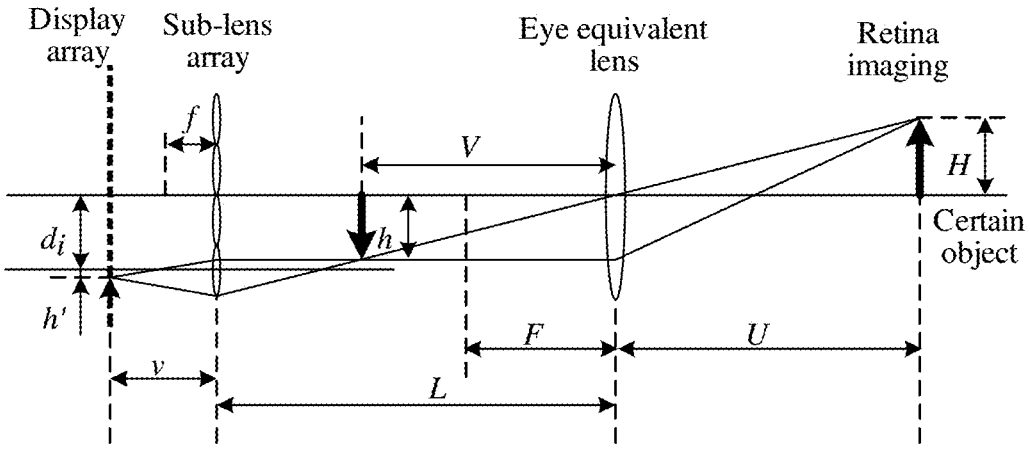
FIG. 6 is an illustration of a light field display equivalent light path according to an example embodiment of the present application.

The light field display is taken as an example, according to an optical imaging principle, the image formed on a retina of a user displayed when the user sees the image displayed by the display array through the sub-lens array corresponds to the image serving as the content to be displayed according to certain proportion, therefore, according to imaging information of the retinas, a corresponding relation between the equivalent image and the display region of the display unit can be derived, and with reference to FIG. 6, a following relational expression can be obtained according to an imaging formula and a triangular geometric relation:

$$\frac{1}{U}+\frac{1}{V}=\frac{1}{F} \tag{1}$$

$$\frac{1}{v}+\frac{1}{L-v}=\frac{1}{f} \tag{2}$$

$$\frac{H}{h}=\frac{U}{V} \tag{3}$$

$$\frac{h-d_i}{h+d_i}=\frac{L-V}{v} \tag{4}$$

wherein, U, V and L, are respectively distances from an eye ball lens to the retina, to displayed image and to the sub-lens array, F and f are respectively focal lengths of an eye ball and the sub-lens, v is a distance from the sub-lens to the pixel of the display unit, H, h, and h' are image surfaces of certain object virtualized on the retina and the image size of the ith sub-lens on the corresponding imaging region, di is a distance between the ith sub-lens and a reference point, the reference point can be any point of the image of the content to be displayed, the reference point takes a crossing point between an optical axis of the eye ball and the display unit as an example for simplifying calculation, and it can be obtained according to the formulas (1)-(4), $$h' = \frac{f(d_i U - LH)}{U(v - f)} + \frac{H}{Uv} \tag{5}$$

For any imaging point on the retina (assuming that the distance from the point to the optical center of the eye ball lens is H, the point equivalently corresponds to certain equivalent point of the image to be displayed, and H is equivalent to relative position information of the relative equivalent image to be displayed of the corresponding point and the reference point corresponding to the optical center of the eye ball lens), h' of the ith sub-lens on the corresponding imaging region can be calculated, that is, an imaging point position thereof on the corresponding imaging region of the ith sub-lens can be obtained by mapping. Therefore, according to the formula (5), when other parameters are kept unchanged, by adjusting v and f, and h' can be adjusted while the formula (1) is established. That is to say, parameters such as a focal length and curvature of the lens and/or the distance between the lens and the display unit can be reasonably adjusted to cause the h' of the ith sub-lens on the corresponding imaging region to be increased, h' reflects the size of the effective region, and when the h' is increased, the effective region of the display unit is also increased.

Specifically, optical parameters of the lens corresponding to the at least one display unit can be adjusted to cause each effective region of the at least one display unit to be increased, and the optical parameters of the lens comprise but are not limited to parameters such as a focal length and curvature of the lens. And/or, the position of the lens is moved, for example, the lens corresponding to the at least one display unit is moved along an optical axis direction thereof to cause each effective region of the at least one display unit to be increased. And/or, the at least one display unit can be moved along a normal direction thereof to cause each effective region of the at least one display unit to be increased. By any foregoing method, each effective region of the at least one display unit is increased, thus, light emitted from more pixels in each display unit of the at least one display unit can be transmitted to a visual angle range of the display system by the lens and enters eyes of the user to image, thereby improving a practical use ratio of the pixels of each display unit. In addition, by matching a solution of adjusting the pixel distribution of the corresponding display unit and/or rotating the display unit around a normal direction thereof, the practical use ratio of the pixels of the corresponding display unit can be further improved, more controllable room is provided for changing the ratio of the pixels distributed along the two directions of the display unit, and it is more favorable for realizing differentiated visual information display of different directions. It needs to be indicated that the operation of the increasing the effective region of the display unit can be performed before the operation of rotating the display unit and/or adjusting the pixel distribution of the display unit, and can also be performed after the operation of rotating the display unit and/or adjusting the pixel distribution of the display unit, a realizing manner is very flexible and is not limited by the embodiment of the present application.

(2) Optionally, changing a ratio of the pixels distributed along the tow directions in each effective region of the at least display unit comprises: causing the at least one display unit to rotate around a normal direction thereof to cause the quantity of the pixels distributed along the first direction of the at least one display unit to be increased; and increasing each effective region of the at least one display unit. For example, as shown in FIG. 6, the display unit is square, the display unit can be rotated around a normal direction thereof by 45 degrees to cause the pixels distributed along the first direction to be increased and the pixels distributed along the second direction of the rotated display unit to be reduced compared with the display unit before change, in addition, the effective region of the display unit is increased, thus, the pixels distributed along the first direction are more than the pixels distributed along the second direction in the effective region, that is, a ratio of the pixels distributed along the first direction and the second direction in the effective region of the display unit is changed. The effective region of the square display unit is larger than the original effective region, optionally, the effective region of the display unit can be adjusted to cause the diameter of the round effective region to be close to or even equal to a diagonal line length of the square display unit, thereby improving the quantity of the pixels distributed along the first direction in the display unit as much as possible.

A realizing manner of increasing the effective region of the at least one display unit is very flexible. For example, the optical parameters of the lens corresponding to the at least one display unit can be adjusted to cause each effective region of the at least one display unit to be increased, the optical parameters of the lens comprise but are not limited to parameters such as a focal length and curvature of the lens; and/or, the position of the lens is moved, for example, the lens corresponding to the at least one display unit is moved along an optical axis direction thereof to cause each effective region of the at least one display unit to be increased; and/or the at least one display unit is moved along a normal direction thereof to cause each effective region of the at least one display unit to be increased. By at least one foregoing method, each effective region of the at least one display unit is increased, thus, by matching the operation of rotating the at least one display unit, the quantity of the pixels distributed along the first direction of the at least one display unit is increased, the quantity of the pixels distributed along the second direction of the at least one display unit is reduced, thereby changing a ratio of the pixels distributed along the two directions of each of the at least one display unit. By the display system comprising the at least one display unit with changed pixel ratio for content display, a proportion of practically displayed parallax information of the at least one display unit respectively in the first direction and the second direction is changed, differentiated display of the visual angle information of different directions is realized to cause the practically displayed content to present differentiated angle resolutions of different angles, thereby better meeting the diversified practical application requirements. It needs to be indicated that the operation of the increasing the effective region of the display unit can be performed before or after the operation of rotating the display unit, a realizing manner is very flexible and is not limited by the embodiment of the present application.

Further, in combination with any display control method according to the embodiment of the present application, optionally, before the changing a ratio of pixels distributed along two directions in each effective display region of at least one display unit of a display system, the method further comprises: determining the first direction. After the first direction is determined, according to a mutual relation between the first direction and the second direction, the second direction can be determined, and differentiated visual angle information display in the first direction and the second direction is realized. In the solution, a visual angle information display direction to be enhanced or weakened can be determined according to practical requirements, and a realizing manner is very flexible and can meet diversified practical application requirements.

Optionally, determining the first direction comprises: determining a horizontal direction parallel with the display unit as the first direction. In the solution, the horizontal direction parallel with the display unit serves as the first direction of visual angle information display to be enhanced or weakened. Research indicates that eyes (left eye and right eye) are in horizontal distribution, causing to certain extent that the eyes are more sensitive to visual angle information in the horizontal direction and are less sensitive to the visual angle information in the vertical direction, leading to that in a content display process, visual information in the horizontal direction and the vertical direction have different visual influences on the eyes in a scene application such as light field reconfiguration. Usually, attention or demand quantity on the visual information in the horizontal direction is larger than that on the visual information in the vertical direction, the horizontal direction parallel with the display unit serves as the first direction, the vertical direction parallel with the display unit serves as the second direction, thus realizing differentiated display of the visual information of different directions of the display unit, the proportion of the visual information of the first direction (horizontal direction) is increased in the image information displayed by the display unit, and/or, the proportion of the visual information of the second direction (vertical direction) is reduced in the image information displayed by the display unit, thereby improving a practical use ratio of resource, and better meeting diversified practical application requirements.

Optionally, determining the first direction comprises: determining a vertical direction parallel with the display unit as the first direction; and correspondingly, the vertical direction parallel with the display unit is the first direction. In the solution, the vertical direction parallel with the display unit serves as the first direction of the visual angle information to be enhanced or weakened, thereby meeting the practical application requirements of displaying the visual angle information needing to be enhanced or weakened in the vertical direction parallel with the display unit.

Optionally, determining the first direction comprises: determining the first direction according to a size of the display system. The size of the display system can be denoted by a transverse length and/or longitudinal length of the display array of the display system. The inventor of the present application finds in a process of practicing the embodiment of the present application that in some cases, the size of the display system may influence a viewing behavior of the user for the display content. For example, a light field reconfigured by the display system presents certain stereoscopic distribution in space, the user can see different visual angle information distributed along the horizontal direction by moving head left and right, for example, see a left view or a right view of certain object; the user can see different visual angle information distributed along the vertical direction by moving the head up and down, for example, see, a top view or a bottom view of certain object. If the longitudinal height of the display system is higher, a probability that the user moves the head to view up and down is lower and a manner that the user moves the head left and right to see different visual angle information is more natural, therefore, the horizontal direction is determined as the first direction, the visual angle information of the first direction is enhanced and displayed to improve an angle resolution of the horizontal direction; the visual angle information in the vertical direction can be weakened and displayed to reduce the data processing volume required by the visual angle information of the vertical direction that the user pays less attention or is less sensitive. In the solution, the direction of the visual angle information display to be enhanced or weakened is determined according to the size of the display system, and it is favorable for meeting diversified practical application requirements.

Optionally, determining the first direction comprises: determining the first direction according to moving information of the display system. The inventor of the present application finds in a process of practicing the embodiment of the present application that the moving information of the display system is related to aspects of a viewing habit, operation and a man-machine interaction manner of the user to some extent. For example, in some game operations, the operation of inclining the display systems such as a smart phone by the user may be involved to realize man-machine interactive control, etc., therefore, the direction of the visual angle information display to be enhanced or weakened can be determined according to the moving information of the display system to cause the practically displayed visual angle information of the more attended, important or sensitive direction to be richer to improve the angle resolution. Further optionally, determining the first direction according to the moving information of the display system comprises: determining a reference direction corresponding to the moving information of the display system as the first direction according to a mapping relation between the moving information of the display system and the reference direction. The reference direction corresponding to the moving information and inclined relative to the horizontal direction of the display system is determined as the horizontal direction, and the reference direction corresponding to the moving information and inclined relative to the vertical direction of the display system is determined as the vertical direction. Thus, in practical application, current moving information of the display system can be obtained by but not limited to parts such as a gravity sensor, and the direction corresponding to the current moving information of the display system is determined as the first direction, the visual angle information in the first direction is enhanced and displayed to improve an angle resolution of the first direction; the visual angle information in the second direction can be weakened and displayed to reduce the data processing volume required by the visual angle information of the vertical direction that the user pays less attention or is less sensitive.

After a ratio of the pixels distributed along the two directions of the at least one display unit of the display system is changed by adopting the technical solution according to the embodiment of the present application, according to practical requirements, a flexible display control technology can be determined for content display control according to the display system with the changed pixel ratio to improve a display effect and user experience, and the embodiment of the present application does not limit a specific display control technology according to the display system with the changed pixel ratio.

In one optional realizing manner, displaying the content to be displayed by the changed display system comprises: performing sampling processing on the content according to pixel actual position information of the at least one changed display unit; and displaying the content after sampling processing by the changed display system. In the solution, whether the image sampling adaptive processing on the content to be displayed according to the adjusted pixel practical position information can be determined according to practical requirements. If yes, sampling processing is performed on the content according to the according to pixel actual position information of the at least one changed display unit to cause the visual angle information of the at least partial object of different directions at the practically displayed content to realize the differentiated display, and further cause the size, shape and other display scales of different regions of the practically displayed content of the display system to match with the size, shape and other display scales of corresponding regions of the original content, thereby improving a display quality and user experience and better meeting diversified practical application requirements.

The light field display is taken as an example for further description.

Figure 7A:
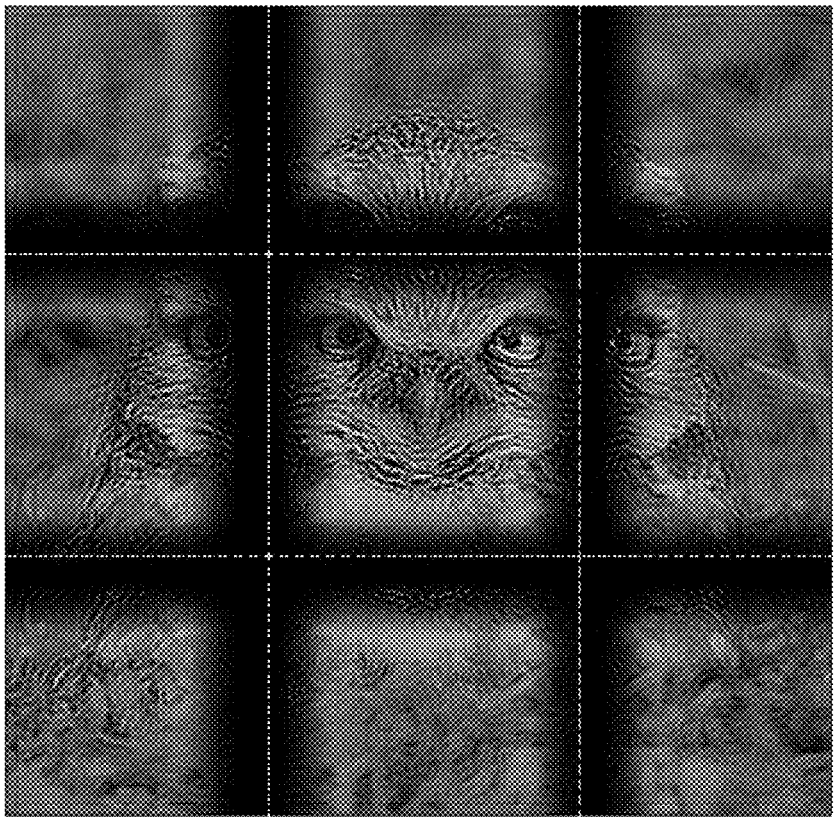
FIG. 7*a* is an illustration of an image to be displayed according to an example embodiment of the present application.
Figure 7B:
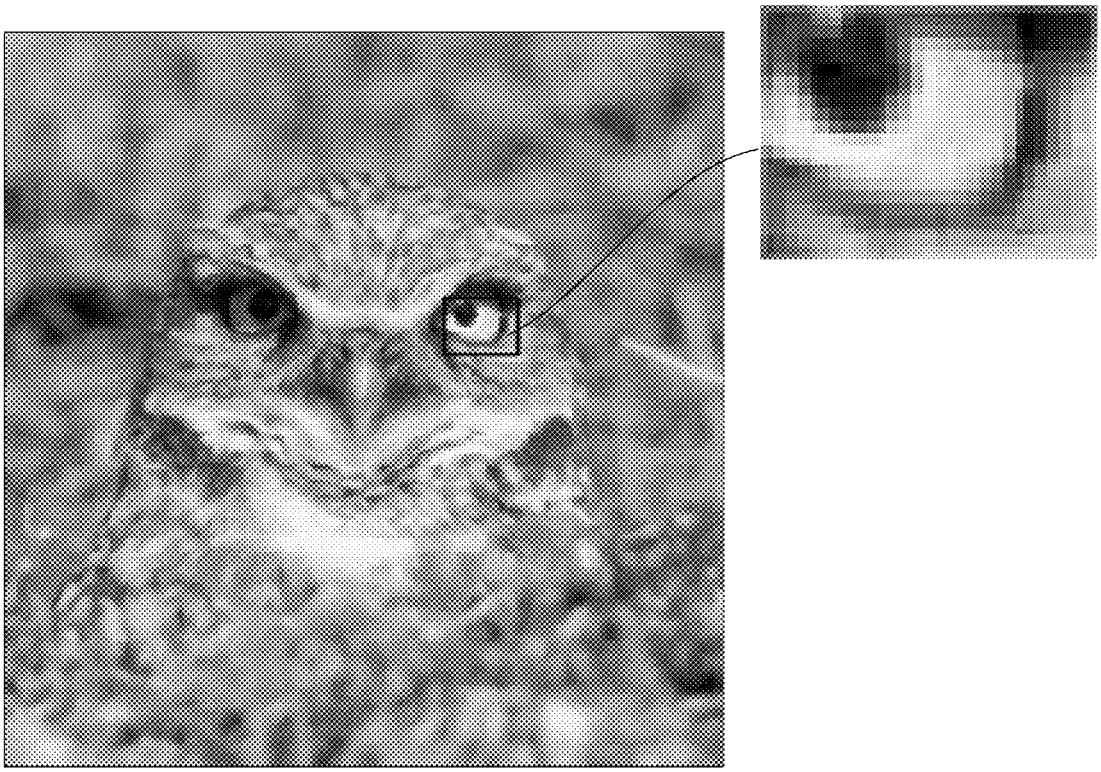
FIG. 7*b* is a display effect illustration of an image displayed by a light field display before change of a pixel ratio according to an example embodiment of the present application.

The original image to be displayed (before sampling) is usually a fuzzy image, as shown in FIG. 7*a*, the fuzzy image is divided into a plurality of sub-images, each sub-image (called as a light field sub-image) is displayed at the at least one display region of the display, in certain cases, the display content has local overlapping, the overlapped content aims to eliminate aberration of converged on human eye retinas by light of a transmitting direction is changed by different sub-lens of different light field sub-images, to cause a display position of the practically displayed content to be adjusted to certain extent in front of and behind a screen, thus enabling a light field image displayed by the display and sawn by eyes through the sub-lens array to be a clear and content-consistent image. If a ratio of the pixels distributed along the horizontal direction and the vertical direction of each of the at least one display unit of the light field display is not changed, the image displayed by the light field sawn from one side of the sub-lens array is as shown in FIG. 7*b* and the angle resolutions of the horizontal direction and the vertical direction in FIG. 7*b* are similar.

Figure 7C:
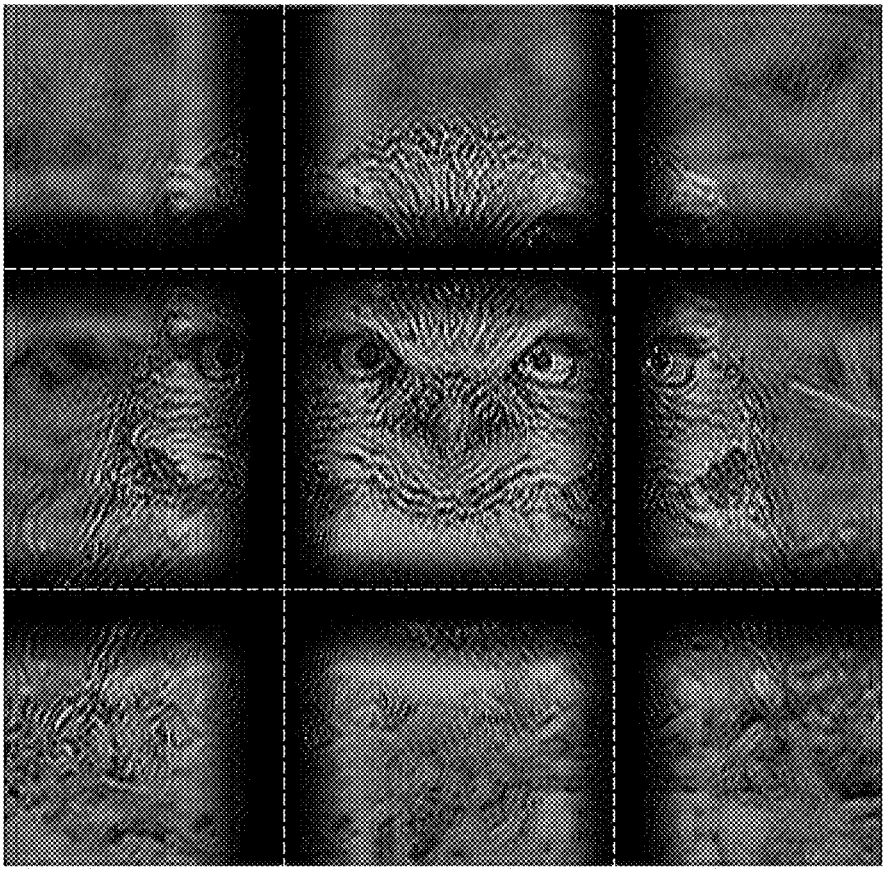
FIG. 7*c* is an illustration of an image to be displayed after sampling processing according to an example embodiment of the present application.
Figure 7D:
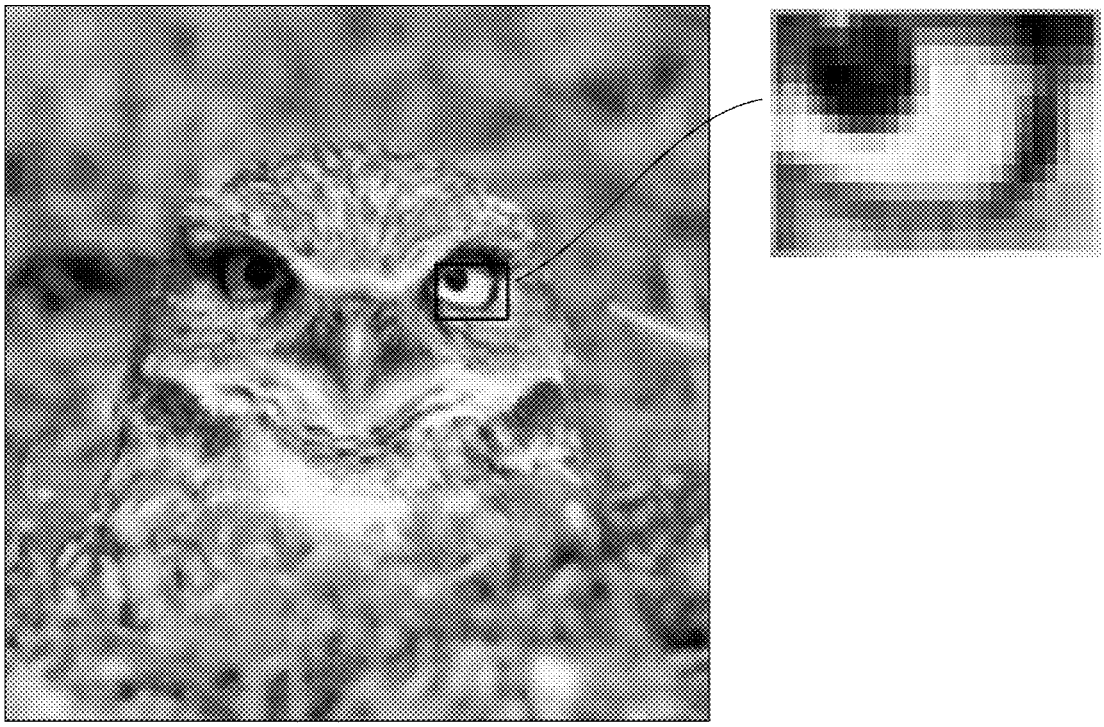
FIG. 7*d* is a display effect illustration of an image after sampling processing displayed by a light field display after change of a pixel ratio according to an example embodiment of the present application.

After by adjusting pixel distribution of each display unit of the light field display, the ratio of the pixels distributed along the horizontal direction and the vertical direction of each display unit is changed, the proportion of the pixels distributed along the horizontal direction and the vertical direction of each display unit is different, thereby meeting a display effect of presenting differentiated angle resolutions of the horizontal direction and the vertical direction. If the image to be displayed is not subjected to sapling processing according to the pixel practical position information of each display unit, deformation of the local of the practically displayed image of the light field display with the changed pixel ratio (for example, the local of the image correspondingly displayed in the horizontal direction with the dense pixels may be increased) may be caused, while in the technical according to the embodiment of the present application, the image to be displayed is subjected to sampling processing according to the pixel practical position information of each display unit with the changed pixel ratio, therefore, on the basis of realizing the differentiated display of the visual angle information along the horizontal direction and the vertical direction of the practically displayed image, the deformation influence on display scales of different parts of the practically displayed image caused by the pixel position adjusting of the display unit is reduced as much possible, thereby improving a display effect and user experience. For example, the original image to be displayed in FIG. 7*a* is subjected to sampling processing according to the pixel practical position information of each display unit of the light field display to obtain a sampled image to be displayed, the practically displayed image, displayed by the light field display with the changed pixel ratio, of the image as shown in FIG. 7*c* is as shown in FIG. 7*d*, and the angle resolution of the horizontal direction relative to the vertical direction in FIG. 7*b* is higher.

In another optional realizing manner, the displaying the content to be displayed by the changed display system comprises: adjusting partial drive information of a corresponding part of the content according to the pixel practical position information of the at least one changed display unit; and controlling the changed display system to display the content according to the changed drive information. In the solution, a scanning drive manner of the corresponding display unit is subjected to drive adaptive adjusting according to the pixel practical position information of the display unit with the changed pixel ration, to cause that on the basis of realizing the differentiated display of the visual angle information of different directions of at least partial object of the practically displayed content, and further the size, shape and other display scales of different regions of the practically displayed content of the display system match with the size, shape and other display scales of corresponding regions of the original content, thereby improving a display quality and user experience and better meeting diversified practical application requirements.

It should be understood by a person skilled in the art that in various embodiments of the present application, the value of the serial number of each step described foregoing does not mean an execution sequence, and the execution sequence of each step should be determined according to the function and internal logic thereof, and should not be any limitation on the implementation procedure of the embodiments of the present application.

Figure 8:
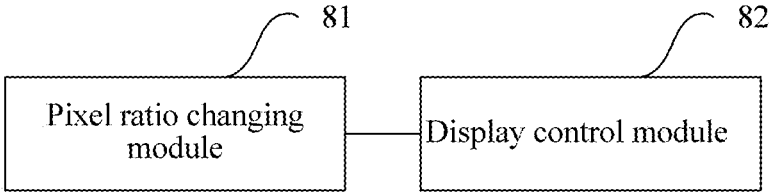
FIG. 8 is a logic block diagram of a first display control apparatus according to an example embodiment of the present application.

FIG. 8 is a logic block diagram of a first display control apparatus according to an embodiment of the present application. As shown in FIG. 8, the display control apparatus according to the embodiment of the present application can comprise: a pixel ratio changing module 801 and a display control module 802.

The pixel ratio changing module 801 is configured to change a ratio of pixels distributed along two directions in each effective display region of at least one display unit of a display system, wherein light emitted by each pixel in the effective display region of each display unit in the at least one display unit is transmitted to a visual angle range by a lens corresponding to the display unit in the display system, and the two directions comprise a first direction and a second direction parallel with the display unit and orthogonal with each other.

The display control module 802 is configured to display a content to be displayed by the changed display system.

According to one or more example embodiments of the present application, a ratio of pixels distributed along the first direction and the second direction in each effective display region of at least one display unit is changed to cause that in each effective display region of the at least one display unit, a quantity of pixels distributed along the first direction and a quantity of pixels distributed along the second direction are different, a pixel ratio of the two is not equal to 1, thus, by using the display system comprising the display unit with the changed pixel ratio for content display, a proportion of practically displayed parallax information of the at least one display unit respectively displayed in the first direction and the second direction is changed, and differentiated display of the visual angle information in different directions is realized to cause the practically displayed content to present differentiated angle resolutions of different directions, thereby better meeting diversified practical application requirements.

A device representing manner of the display control apparatus is not limited, for example, the display control apparatus can be some or one independent part, which matches and communicates with a display system comprising display unit; or the display control apparatus can be integrated in the display system comprising the display unit as certain function module.

Optionally, the display system comprises a light field display, the light field display comprises a display array and a sub-lens array, which are arranged in sequence, the sub-lens array comprises a plurality of lens in array distribution, the display array comprises a plurality of display units in array distribution. Optionally, in a realizing manner for content display by the light field display, the multidirectional visual angle information of at least one object in the content is respectively displayed by the pixels of the one of the at least one display unit, or the multidirectional visual angle information of at least one object in the content is respectively displayed by at least two of the at least one display unit. In the solution, by changing a ratio of the pixels along two orthogonal directions of the at least one display unit of the light field display, a proportion of respectively practically displayed parallax information of the at least one display unit in the first direction and the second direction can be changed, and differentiated display of the visual angle information in different directions is realized to cause the practically displayed content to present differentiated angle resolutions in different directions, thereby better meeting diversified practical application requirements.

Optionally, the display system comprises a display array, the display array comprises a plurality of displays in array distribution, and the display comprises one display unit and one lens arranged in sequence. Optionally, in a realizing manner of for content display based on the display array, the multidirectional visual angle information of at least one object in the content is transmitted the lenses. In the solution, by changing the pixel ratio of each of the display units of the display array along two orthogonal directions, a proportion of respectively practically displayed parallax information of the display units in the first direction and the second direction can be changed, and differentiated display of the multidirectional visual angle information in different directions is realized to cause the practically displayed content to present differentiated angle resolutions of different directions, thereby better meeting diversified practical application requirements.

Figure 9:
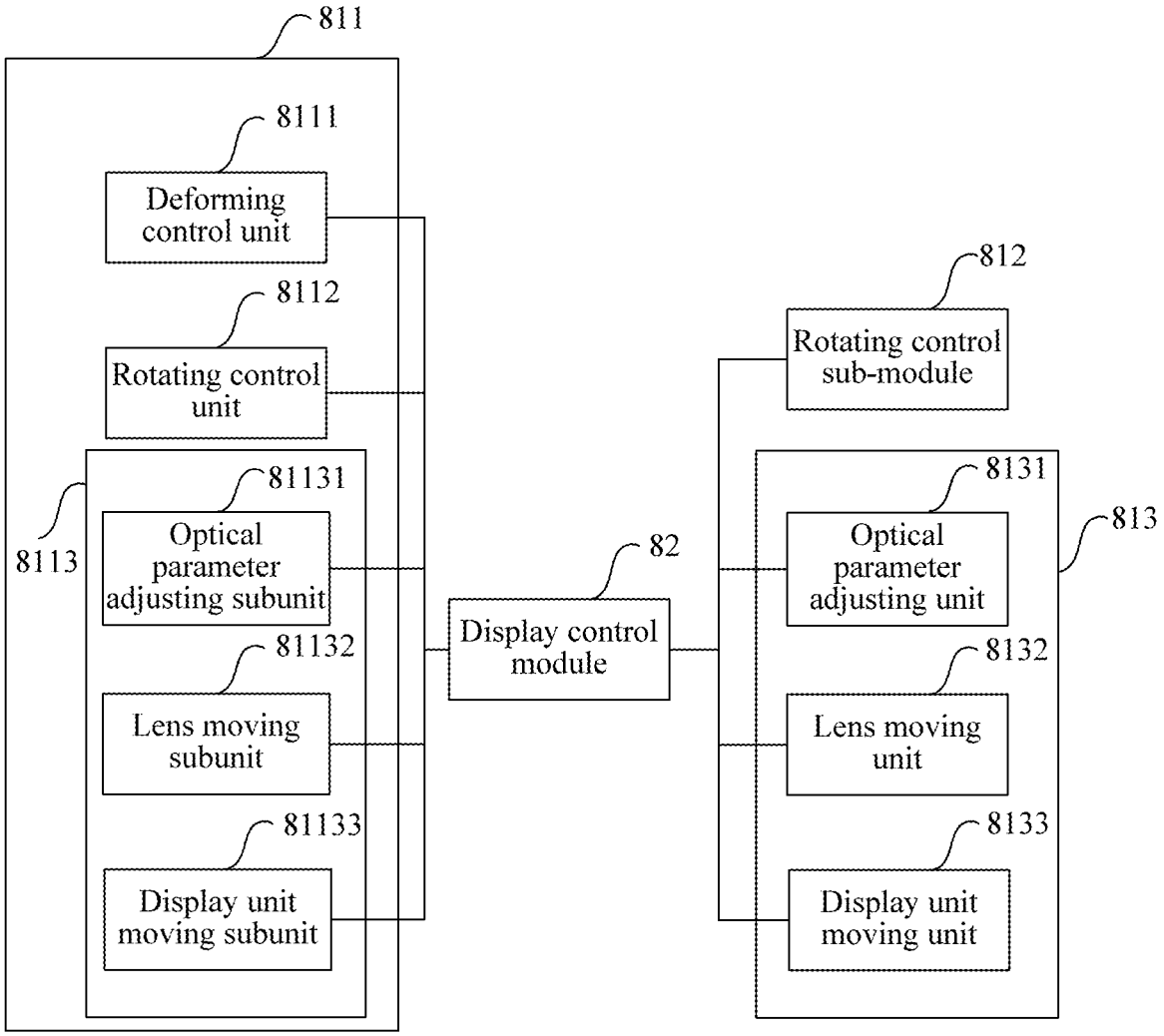
FIG. 9 is a logic block diagram of a second display control apparatus according to an example embodiment of the present application.

Optionally, as shown in FIG. 9, the pixel ratio changing module 81 comprises: a pixel distribution adjusting sub-module 811. The pixel distribution adjusting sub-module 811 is configured to adjust pixel distribution of the at least one display unit to change a ratio of the pixels along two directions in each effective display region of the at least one display unit. The solution makes full use of the characteristic that the pixel distribution of the display unit is adjustable, the pixel distribution of the display unit is adjusted to cause that in the effective region of the display unit, intervals of the pixels distributed along the first direction and intervals of the pixels distributed along the second direction are different, that is to say, by adjusting the pixel distribution of the display unit, quantities of the pixels distributed along the first direction and the second direction in the effective region of the display unit are different, a pixel ratio is not equal to 1, thus, by the display system comprising the display unit with adjusted pixel distribution for content display, a proportion of practically displayed parallax information of the display unit in the first direction and the second direction can be changed, and differentiated display of the multidirectional visual angle information of different directions is realized to cause the practically displayed content to present differentiated angle resolutions in different directions, thereby better meeting diversified practical application requirements.

Optionally, the pixel distribution adjusting sub-module 811 comprises a deforming control unit 8111. The deforming control unit 8111 is configured to control the at least one display unit to be deformed to cause the quantity of pixels distributed along the first direction in the effective region of the at least one display unit to be increased, and/or the quantity of pixels distributed along the second direction to be reduced. The solution performs pixel distribution adjusting by flexible deforming control over the at least one display unit, to cause a ratio of pixels distributed along two directions in the effective region with the adjusted pixel distribution to meet practical application requirements.

Optionally, the pixel distribution adjusting sub-module 811 further comprises a rotating control unit 8112. The rotating control unit 8112 is configured to cause the at least one display unit to rotate around a normal direction thereof to cause the quantity of pixels distributed along the first direction of the at least one display unit to be increased. The solution causes the quantity of the pixels distributed along the first direction of the rotated display unit to be increased compared with that before the display unit is rotated, thereby increasing a controllable room of the quantity of the pixels distributed along the first direction in the effective region by controlling the display unit to be deformed, being favorable for adjusting more pixels distributed along the first direction in the existing pixels of the display unit into the effective region, and further being favorable for increasing a proportion of the visual information of the first direction comprised in the content displayed by the display unit, realizing the differentiated display of the visual information of different directions, and improving a practical use ratio of the resource as much as possible.

Optionally, the pixel distribution adjusting sub-module 811 further comprises an effective region increasing unit 8113. The effective region increasing unit 8113 is configured to increase each effective region of the at least one display unit. The solution can improve a practical use ratio of the pixels of the display unit, causes a controllable room of the quantity of the pixels distributed along the first direction in the effective region by controlling the display unit to be deformed to be increased, and is favorable for realizing differentiated visual information display of different directions.

Optionally, the pixel distribution adjusting sub-module 811 comprises an optical parameter adjusting subunit 81131. The optical parameter adjusting subunit 81131 is configured to at least adjust optical parameters of the lens corresponding to the at least one display unit to cause each effective region of the at least one display unit to be increased. The optical parameters of the lens comprise but are not limited to parameters such as a focal length and curvature of the lens. The solution can increase each effective region of the at least one display unit by adjusting the optical parameters of the lens corresponding to the at least one display unit.

Optionally, the pixel distribution adjusting sub-module 811 comprises a lens moving subunit 81132. The lens moving subunit 81132 is configured to move the lens corresponding to the at least one display unit to move along an optical axis direction thereof to cause each effective region of the at least one display unit to be increased. The solution can increase each effective region of the at least one display unit by moving the lens corresponding to the at least one display unit along an optical axis thereof.

Optionally, the effective region increasing unit 8113 comprises a display unit moving subunit 81133. The display unit moving subunit 81133 is configured to move the at least one display unit to move along a normal direction thereof to cause each effective region of the at least one display unit to be increased. The solution can increase each effective region of the at least one display unit by moving the at least one display unit along its corresponding normal.

Optionally, the pixel ratio changing module 81 comprises a rotating control sub-module 812 and an effective region increasing sub-module 813. The rotating control sub-module 812 is configured to rotate the at least one display unit to rotate around a normal direction thereof to cause the quantity of the pixels distributed along the first direction of the at least one display unit to be increased; the effective region increasing sub-module 813 is configured to increase each effective region of the at least one display unit. The solution causes the pixels distributed along the first direction to be increased and the pixels distributed along the second direction of the rotated display unit to be reduced compared with the display unit before change, in addition, the effective region of the display unit is increased, thus, the pixels distributed along the first direction are more than the pixels distributed along the second direction in the effective region, that is, a ratio of the pixels distributed along the first direction and the second direction in the effective region of the display unit is changed. The effective region of the square display unit is larger than the original effective region, optionally, the effective region of the display unit can be adjusted to cause the diameter of the round effective region to be close to or even equal to a diagonal line length of the square display unit, thereby improving the quantity of the pixels distributed along the first direction in the display unit as much as possible.

Optionally, the effective region increasing sub-module 813 comprises: an optical parameter adjusting unit 8131. The optical parameter adjusting unit 8131 is configured to at least adjust optical parameters of the lens corresponding to the at least one display unit to cause each effective region of the at least one display unit to be increased. The optical parameters of the lens comprise but are not limited to parameters such as a focal length and curvature of the lens. The solution can increase each effective region of the at least one display unit by adjusting the optical parameters of the lens corresponding to the at least one display unit.

Optionally, the effective region increasing sub-module 813 comprises: a lens moving unit 8132. The lens moving unit 8132 is configured to move the lens corresponding to the at least one display unit to move along an optical axis direction thereof to cause each effective region of the at least one display unit to be increased. The solution can increase each effective region of the at least one display unit by moving the lens corresponding to the at least one display unit along an optical axis thereof.

Optionally, the effective region increasing sub-module 813 comprises: a display unit moving unit 8133. The display unit moving unit 8133 is configured to move the at least one display unit to move along a normal direction thereof to cause each effective region of the at least one display unit to be increased. The solution can increase each effective region of the at least one display unit by moving the at least one display unit along its corresponding normal.

Figure 10:
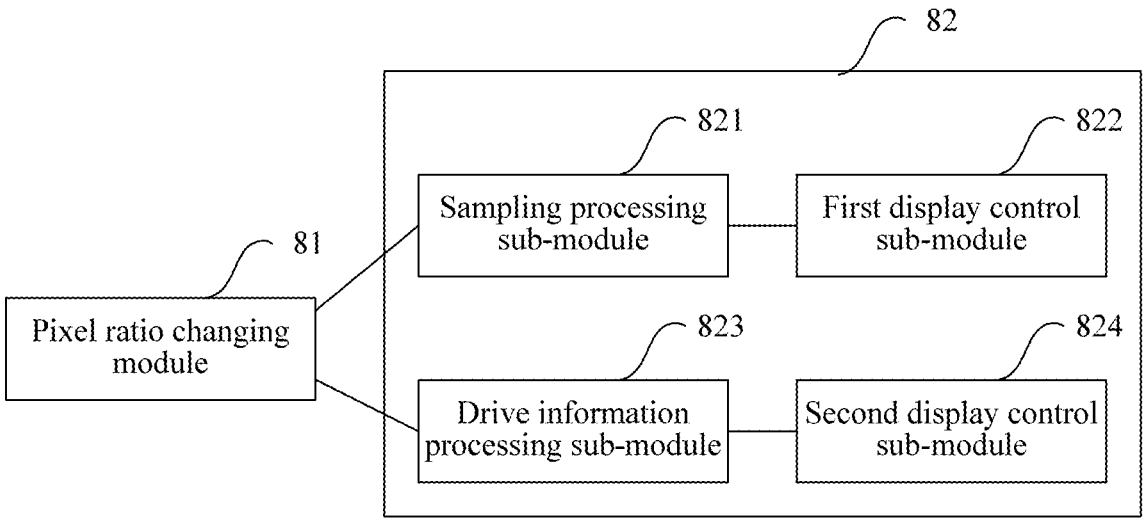
FIG. 10 is a logic block diagram of a third display control apparatus according to an example embodiment of the present application.

Optionally, as shown in FIG. 10, the display control module 82 comprises a sampling processing sub-module 821 and a first display control sub-module 822. The sampling processing sub-module 821 is configured to perform sampling processing on the content according to pixel actual position information of the at least one changed display unit; and the first display control sub-module 822 is configured to display the content after sampling processing by the changed display system. In the solution, whether the image sampling adaptive processing on the content to be displayed according to the adjusted pixel practical position information can be determined according to practical requirements. If yes, sampling processing is performed on the content according to the according to pixel actual position information of the at least one changed display unit to cause the visual angle information of the at least partial object of different directions at the practically displayed content to realize the differentiated display, and further cause the size, shape and other display scales of different regions of the practically displayed content of the display system to match with the size, shape and other display scales of corresponding regions of the original content, thereby improving a display quality and user experience and better meeting diversified practical application requirements.

Optionally, the display control module 82 comprises a drive information processing sub-module 823 and a second display control sub-module 824. The drive information processing sub-module 823 is configured to adjust partial drive information of a corresponding part of the content according to the pixel practical position information of the at least one changed display unit; and the second display control sub-module 824 is configured to control the changed display system to display the content according to the changed drive information. In the solution, a scanning drive manner of the corresponding display unit is subjected to drive adaptive adjusting according to the pixel practical position information of the display unit with the changed pixel ration, to cause that on the basis of realizing the differentiated display of the visual angle information of different directions of at least partial object of the practically displayed content, and further the size, shape and other display scales of different regions of the practically displayed content of the display system match with the size, shape and other display scales of corresponding regions of the original content, thereby improving a display quality and user experience and better meeting diversified practical application requirements.

Figure 11:
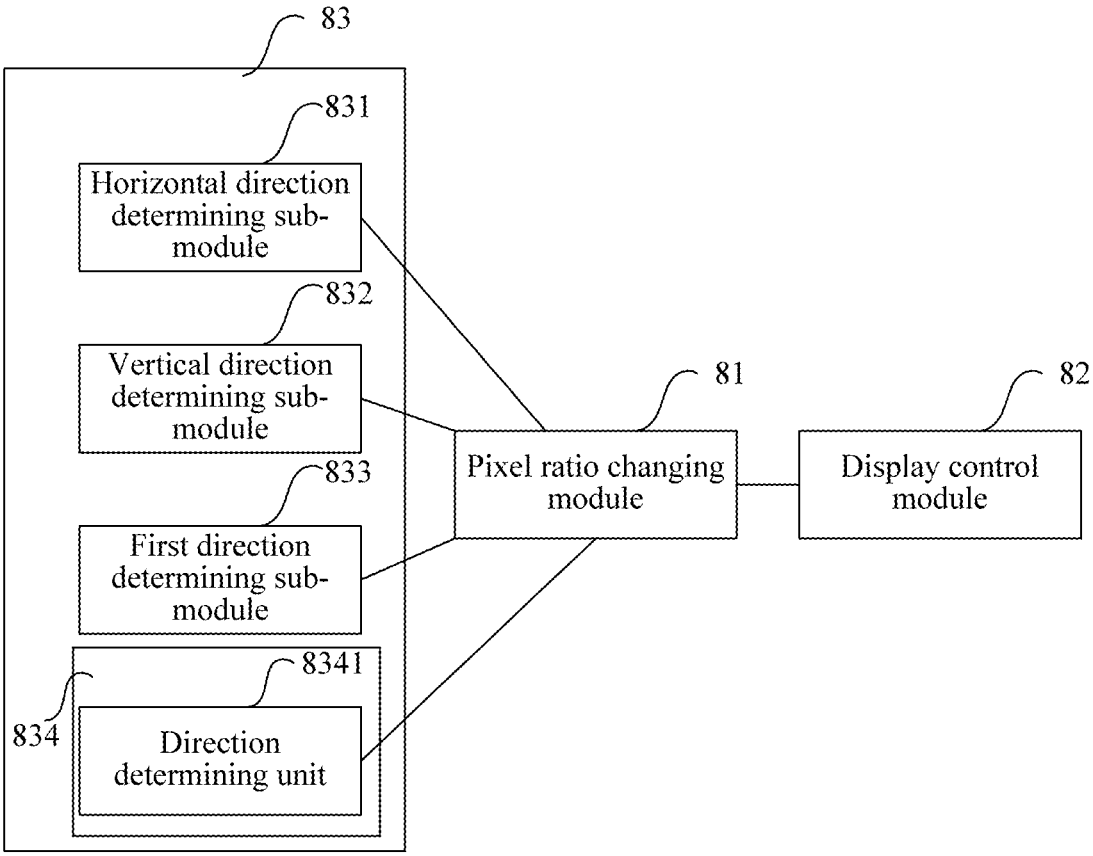
FIG. 11 is a logic block diagram of a fourth display control apparatus according to an example embodiment of the present application.

Optionally, as shown in FIG. 11, the display control apparatus further comprises: a direction determining module 83. The direction determining module 83 is configured to determine the first direction. In the solution, a visual angle information display direction to be enhanced or weakened can be determined according to practical requirements, and a realizing manner is very flexible and can meet diversified practical application requirements.

Optionally, the direction determining module 83 comprises a horizontal direction determining sub-module 831, configured to determine a horizontal direction parallel with the display unit as the first direction. In the solution, the horizontal direction parallel with the display unit serves as the first direction of visual angle information display to be enhanced or weakened, thereby meeting the practical application requirements of display of the visual angle information required to be enhanced or weakened of the horizontal direction of the display unit.

Optionally, the direction determining module 83 comprises a vertical direction determining sub-module 832. The vertical direction determining sub-module 832 is configured to determine a vertical direction parallel with the display unit as the first direction. In the solution, the vertical direction parallel with the display unit serves as the first direction of visual angle information display to be enhanced or weakened, thereby meeting the practical application requirements of display of the visual angle information needing to be enhanced or weakened of the vertical direction of the display unit.

Optionally, the direction determining module 83 comprises a first direction determining sub-module 833. The first direction determining sub-module 833 is configured to determine the first direction according to the size of the display system. In the solution, the direction of the visual angle information display to be enhanced or weakened is determined according to the size of the display system, and it is favorable for meeting diversified practical application requirements.

Optionally, the direction determining module 83 comprises a moving direction determining sub-module 834. The moving direction determining sub-module 834 is configured to determine the first direction according to moving information of the display system. In the solution, the direction of the visual angle information display to be enhanced or weakened can be determined according to the moving information of the display system to cause the practically displayed visual angle information of the more attended, important or sensitive direction to be richer to improve the angle resolution.

Further optionally, the moving direction determining sub-module 834 comprises a direction determining unit 8341. The direction determining unit 8341 is configured to determine a reference direction corresponding to the moving information of the display system as the first direction according to a mapping relation between the moving information of the display system and the reference direction. In the solution, the direction corresponding to current moving information of the display system is determined as the first direction, the visual angle information of the first direction is enhanced and displayed to improve an angle resolution of the horizontal direction; the visual angle information in the second direction can be weakened and displayed to reduce the data processing volume required by the visual angle information of the vertical direction that the user pays less attention or is less sensitive.

Figure 12:
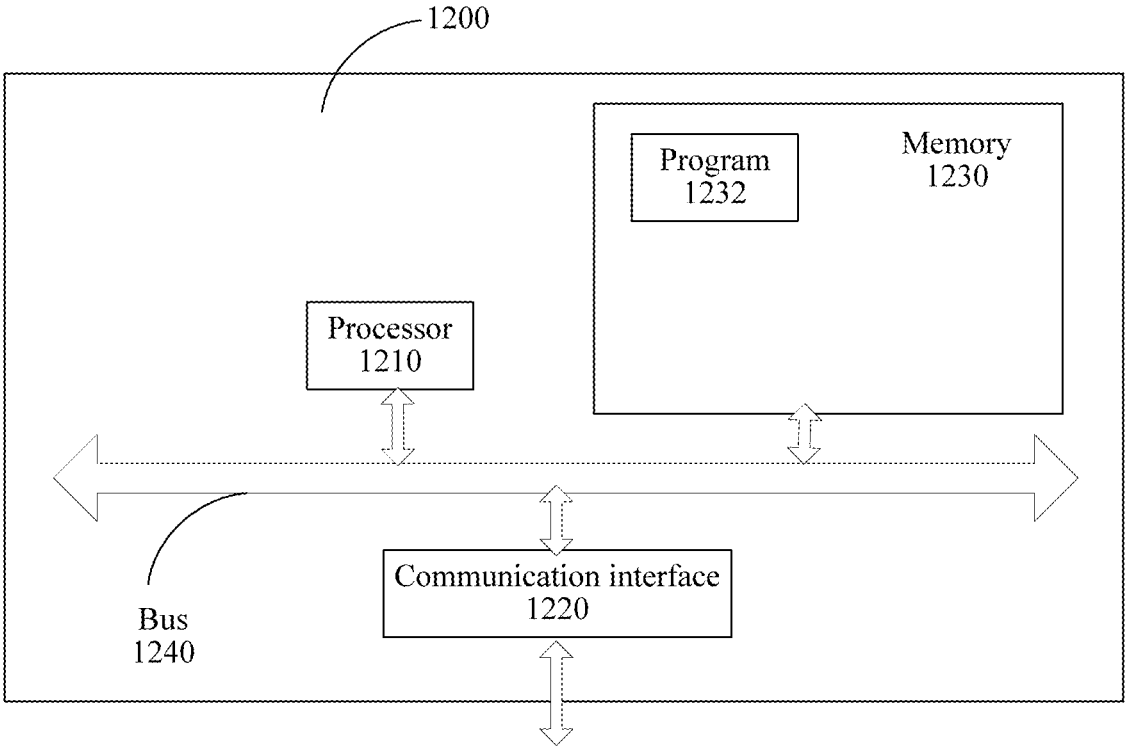
FIG. 12 is a logic block diagram of a fifth display control apparatus according to an example embodiment of the present application.

FIG. 12 is a logic block diagram of a fifth display control apparatus according to an embodiment of the present application. The embodiment of the present application does not limit a specific realizing manner of the display control apparatus 1200. As shown in FIG. 12, the display control apparatus 1200 can comprise:

a processor 1210, a communication interface 1220, a memory 1230 and a communication bus 1240;

the processor 1210, the communication interface 1220 and the memory 1230 finish mutual communication by the communication bus 1240.

The communication interface 1220 is configured to communicate with a device with a communicating function, an external light source and the like.

The processor 1210 is configured to execute a program 1232, and specifically execute related steps in the embodiments of any display control method.

For example, the program 1232 can comprise a program code, and the program code comprises a computer operation command.

The processor 1210 can be a central processing unit (CPU), or an application specific integrated circuit (ASIC), or may be configured as one or more integrated circuits that implement the embodiments of the present application.

The memory 1230 is configured to store the program 1232. The memory 1230 can comprise a high speed random access memory (RAM), and can also comprise a non-volatile memory such as at least one magnetic disk memory.

For example, in one optional realizing manner, the processor 1210 can execute the following steps by executing the program 1232:

changing a ratio of pixels distributed along two directions in each effective display region of at least one display unit of a display system, wherein light emitted by each pixel in the effective display region of each display unit in the at least one display unit is transmitted to a visual angle range by a lens corresponding to the display unit in the display system, and the two directions comprise a first direction and a second direction parallel with the display unit and orthogonal with each other; and displaying a content to be displayed by the changed display system.

In other optional realizing manners, the processor 1210 can execute the steps mentioned in any foregoing embodiment by executing the program 1232 which is not repeated herein.

For the specific implementation of the steps in the program 1232 refers to the corresponding descriptions of corresponding steps, modules, sub-modules and units in the foregoing embodiments, which are not repeated herein. It may be clearly understood by a person skilled in the art that, for the purpose of convenient and brief description, reference may be made to the description of corresponding procedures in the foregoing method embodiments for detailed working procedures of the foregoing devices and modules, and details are not repeated herein.

In forgoing embodiments of the present application, serial numbers and/or sequence of the embodiments are merely for the purpose of description and are not representative of good and poor embodiments. Description on each embodiment has an emphasis, and the part not described in detail in certain embodiment can refer to related description of other embodiments. Related description of the implementing principles or processes of the apparatus, device or system embodiments can refer to recording of corresponding embodiments and is repeated herein.

It can be appreciated by a person of ordinary skill in the art that, exemplary units and method steps described with reference to the embodiments disclosed in this specification can be implemented by electronic hardware or a combination of computer software and electronic hardware. Whether these functions are executed by hardware or software depends on specific applications and design constraints of the technical solution. A person skilled in the art may use different methods to implement the described functions for each specific application, but such implementation should not be construed as a departure from the scope of the present application.

If the function is implemented in the form of a software functional unit and is sold or used as an independent product, the product can be stored in a computer-readable storage medium. Based on this understanding, the technical solution of the present application essentially, or the part that contributes to the prior art, or a part of the technical solution may be embodied in the form of a software product; the computer software product is stored in a storage medium and comprises several instructions for enabling a computer device (which may be a personal computer, a server, a network device, or the like) to execute all or some of the steps of the method in the embodiments of the present application. The foregoing storage medium comprises a USB flash drive, a removable hard disk, a read-only memory (ROM), a random access memory (RAM), a diskette or a compact disk that can be used for storing a program code.

In the apparatus, method and system embodiments of the present application, obviously, each part (system, subsystem, module, sub-module, unit, subunit and the like) or each step can be decomposed, combined and/or recombined after being decomposed. These decomposition and/or recombination should be regarded as equivalent solutions of the present application. Meanwhile, in the forgoing description of specific embodiments, the characteristics described and/or shown aiming at one embodiment can be used in one or more other embodiments in a same or similar manner, can be combined with the characteristics in other embodiments or replace the characteristics in other embodiments.

It should be emphasized that the terms "comprising/containing" denote existence of characteristics, elements, steps or components when used in the specification, but do not exclude existence or addition of one or more other characteristics, elements, steps or components.

Finally, it should be indicated that the above implementations are only used to describe the present application, rather than limit the present application; various alterations and variants can be made by those of ordinary skill in the art without departing from the spirit and scope of the present application, so all equivalent technical solutions also belong to the scope of the present application, and the scope of patent protection of the present application should be defined by claims.

What is claimed is:

1. A method, comprising:

changing, by a system comprising a processor, a ratio of pixels distributed along two directions in each effective display region of at least one display unit of a display system resulting in a changed display system by adjusting intervals between partial pixels by means of controlling at least local deformation of the at least one display unit, wherein light emitted by each pixel in a corresponding effective display region of each display unit in the at least one display unit is transmitted according to a visual angle range by a respective lens corresponding to each display unit in the display system, wherein the two directions comprise a first direction and a second direction that are parallel with an associated display unit and orthogonal with each other, wherein each effective display region is part of a different corresponding display unit of the at least one display unit, wherein each effective display region is a circle region taking a circle center of a corresponding display unit as a center, wherein the at least one display unit is at least one square display unit, and wherein the changing the ratio of pixels distributed along the two directions in each effective display region of the at least one display unit comprises determining the first direction based on determining a horizontal direction parallel with the at least one display unit as the first direction;

rotating, by the system, the at least one display unit around a normal direction of the at least one display unit by 45 degrees to cause a first quantity of pixels distributed along the first direction of the at least one display unit to be increased;

increasing, by the system, a diameter of the circle region of each effective display region of the at least one display unit to fit a diagonal line length of the at least one square display unit; and displaying content to be displayed by the changed display system.

2. The method of claim 1, wherein the display system comprises a light field display, wherein the light field display comprises a display array and a sub-lens array, which are arranged in sequence, wherein the sub-lens array comprises a plurality of lenses in a first array distribution, and wherein the display array comprises a plurality of display units in a second array distribution.

3. The method of claim 2, wherein multifunctional visual angle information of at least one object in the content is respectively displayed by a plurality of pixels of a display unit of the at least one display unit.

4. The method of claim 2, wherein multifunctional visual angle information of at least one object in the content is respectively displayed by at least two of the at least one display unit.

5. The method of claim 1, wherein the display system comprises a display array, wherein the display array comprises a plurality of displays in an array distribution, and wherein a display of the plurality of displays comprises a display unit of the at least one display unit and a lens arranged in sequence.

6. The method of claim 5, wherein multifunctional visual angle information of at least one object in the content is respectively displayed by a plurality of lenses.

7. The method of claim 1, wherein the changing the ratio of pixels distributed along the two directions in each effective display region of the at least one display unit further comprises:

adjusting a pixel distribution of the at least one display unit to change the ratio of the pixels along the two directions in each effective display region of the at least one display unit.

8. The method of claim 7, wherein the adjusting the pixel distribution comprises:

controlling the at least one display unit to be deformed to cause at least one of the first quantity of pixels distributed along the first direction in each effective display region of the at least one display unit to be increased, or a second quantity of pixels distributed along the second direction to be reduced.

9. The method of claim 1, wherein the increasing each effective display region of the at least one display unit comprises:

at least adjusting at least one optical parameter of at least one lens corresponding to the at least one display unit to cause each effective display region of the at least one display unit to be increased.

10. The method of claim 1, wherein the increasing each effective display region of the at least one display unit comprises:

at least moving at least one lens corresponding to the at least one display unit along an optical axis direction of the at least one display unit to cause each effective display region of the at least one display unit to be increased.

11. The method of claim 1, wherein the increasing each effective display region of the at least one display unit comprises:

causing the at least one display unit to move along a normal direction of the at least one display unit to cause each effective display region of the at least one display unit to be increased.

12. The method of claim 1, further comprising determining the first direction according to moving information of the display system comprises:

determining a reference direction, corresponding to the moving information of the display system, as the first direction according to a mapping relation between the moving information of the display system and the reference direction.

13. The method of claim 1, wherein the changed display system comprises at least one changed display unit, and wherein the displaying the content to be displayed by the changed display system comprises:

performing sampling processing on the content according to pixel actual position information of the at least one changed display unit; and displaying the content after sampling processing by the changed display system.

14. The method of claim 1, wherein the changed display system comprises at least one changed display unit, and wherein the displaying the content to be displayed by the changed display system comprises:

adjusting partial drive information of a corresponding part of the content according to pixel practical position information of the at least one changed display unit, resulting in changed drive information; and controlling the changed display system to display the content according to the changed drive information.

15. The method of claim 1, wherein the at least one display unit comprises a controllable deforming material part.

16. The method of claim 1, wherein the at least one display unit comprises an elastic part.

17. An apparatus, comprising:

a memory that stores executable modules; and a processor, coupled to the memory, that executes or facilitates execution of the executable modules, the executable modules comprising:

a pixel ratio changing module configured to change a ratio of pixels distributed along two directions in each effective display region of at least one display unit of a display system resulting in a changed display system by adjusting intervals between partial pixels by means of controlling at least local deformation of the at least one display unit, wherein light emitted by each pixel in each effective display region of each display unit in the at least one display unit is transmitted to a visual angle range by each lens corresponding to each display unit in the display system, wherein the two directions comprise a first direction and a second direction that are parallel with an associated display unit and orthogonal with each other, wherein each effective display region is part of a different corresponding display unit of the at least one display unit, wherein each effective display region is a circle region taking a circle center of a corresponding display unit as a center, wherein the at least one display unit is at least one square display unit, and wherein the pixel ratio changing module is further configured to determine the first direction based on a horizontal direction that is parallel with the at least one display unit, wherein the pixel ratio changing module further comprises:

a rotating control unit configured to rotate the at least one display unit around a normal direction thereof by 45 degrees to cause a quantity of pixels distributed along the first direction of the at least one display unit to be increased, and an effective region increasing unit configured to increase a diameter of the circle region of each effective display region of the at least one display unit to fit a diagonal line length of the at least one square display unit; and a display control module configured to display content to be displayed by the changed display system.

18. The apparatus of claim 17, wherein the display system comprises a light field display, the light field display comprises a display array and a sub-lens array, which are arranged in sequence, the sub-lens array comprises a plurality of lenses in a first array distribution, and the display array comprises a plurality of display units in a second array distribution.

19. The apparatus of claim 18, wherein multifunctional visual angle information of at least one object in the content is displayed by a plurality of pixels of a display unit of the at least one display unit.

20. The apparatus of claim 18, wherein multifunctional visual angle information of at least one object in the content is displayed by at least two display units of the at least one display unit.

21. The apparatus of claim 17, wherein the display system comprises a display array, the display array comprises a plurality of displays in array distribution, and a display of the plurality of displays comprises one display unit and one lens arranged in sequence.

22. The apparatus of claim 21, wherein multifunctional visual angle information of at least one object in the content is respectively displayed by a plurality of lenses.

23. The apparatus of claim 17, wherein the pixel ratio changing module comprises:

a pixel distribution adjusting sub-module configured to adjust a pixel distribution of the at least one display unit to change the ratio of the pixels along the two directions in each effective display region of the at least one display unit.

24. The apparatus of claim 23, wherein the pixel distribution adjusting sub-module comprises:

a deforming control unit configured to control the at least one display unit to be deformed to cause at least one of a first quantity of pixels distributed along the first direction in each effective display region of the at least one display unit to be increased, or a second quantity of pixels distributed along the second direction to be reduced.

25. The apparatus of claim 17, wherein the effective region increasing unit comprises:

an optical parameter adjusting subunit configured to at least adjust optical parameters of at least one lens corresponding to the at least one display unit to cause each effective display region of the at least one display unit to be increased.

26. The apparatus of claim 25, wherein the effective region increasing unit comprises:

a lens moving subunit configured to move the at least one lens corresponding to the at least one display unit to move along an optical axis direction thereof to cause each effective display region of the at least one display unit to be increased.

27. The apparatus of claim 17, wherein the effective region increasing unit comprises:

a display unit moving subunit configured to move the at least one display unit to move along a normal direction thereof to cause each effective display region of the at least one display unit to be increased.

28. The apparatus of claim 17, wherein the pixel ratio changing module further comprises:

a direction determining unit configured to determine a reference direction corresponding to a moving information of the display system as the first direction according to a mapping relation between the moving information of the display system and the reference direction.

29. The apparatus of claim 17, wherein the change of the ratio of pixels results in at least one changed display unit, and wherein the display control module comprises:

a sampling processing sub-module configured to perform sampling processing on the content according to pixel actual position information of the at least one changed display unit; and a first display control sub-module configured to display the content after the sampling processing by the changed display system.

30. The apparatus of claim 17, wherein the change of the ratio of pixels results in at least one changed display unit, and wherein the display control module comprises:

a drive information processing sub-module configured to adjust partial drive information of a corresponding part of the content according to pixel practical position information of the at least one changed display unit, resulting in changed drive information; and a second display control sub-module configured to control the changed display system to display the content according to the changed drive information.

31. The apparatus of claim 17, wherein the at least one display unit comprises a controllable deforming material part.

32. The apparatus of claim 17, wherein the at least one display unit comprises an elastic part.

33. A display control apparatus, comprising a processor, a communication interface, a memory and a communication bus, wherein the processor, the communication interface and the memory finish perform mutual communication by the communication bus, wherein the memory is configured to store at least one command, and wherein the at least one command enables the processor to execute operations, comprising:

changing a ratio of pixels distributed along two directions in each effective display region of at least one display unit of a display system resulting in a changed display system by adjusting intervals between partial pixels by means of controlling at least local deformation of the at least one display unit, wherein light emitted by each pixel in a corresponding effective display region of each display unit in the at least one display unit is transmitted according to a visual angle range by a respective lens corresponding to each display unit, and wherein the two directions comprise a first direction and a second direction that are parallel with an associated display unit and orthogonal with each other, wherein each effective display region is part of a different corresponding display unit of the at least one display unit, wherein each effective display region is a circle region taking a circle center of a corresponding display unit as a center, wherein the at least one display unit is at least one square display unit, and wherein the changing the ratio of pixels distributed along the two directions in each effective display region of the at least one display unit further comprises determining the first direction based on determining a horizontal direction parallel with the at least one display unit as the first direction;

rotating the at least one display unit around a normal direction of the at least one display unit by 45 degrees to cause a first quantity of pixels distributed along the first direction of the at least one display unit to be increased;

increasing a diameter of the circle region of each effective display region of the at least one display unit to fit a diagonal line length of the at least one square display unit; and displaying content to be displayed by the changed display system.

34. The display control apparatus of claim 33, wherein the display system comprises a light field display, wherein the light field display comprises a display array and a sub-lens array, which are arranged in sequence, wherein the sub-lens array comprises a plurality of lenses in a first array distribution, and wherein the display array comprises a plurality of display units in a second array distribution.

35. The display control apparatus of claim 34, wherein multifunctional visual angle information of at least one object in the content is respectively displayed by a plurality of pixels of a display unit of the at least one display unit.

36. The display control apparatus of claim 34, wherein multifunctional visual angle information of at least one object in the content is respectively displayed by at least two of the at least one display unit.

37. The display control apparatus of claim 33, wherein the display system comprises a display array, wherein the display array comprises a plurality of displays in an array distribution, and wherein a display of the plurality of displays comprises a display unit of the at least one display unit and a lens arranged in sequence.

38. The display control apparatus of claim 37, wherein multifunctional visual angle information of at least one object in the content is respectively displayed by a plurality of lenses.

39. The display control apparatus of claim 33, wherein the changing the ratio of pixels distributed along the two directions in each effective display region of the at least one display unit further comprises:

adjusting a pixel distribution of the at least one display unit to change the ratio of the pixels along the two directions in each effective display region of the at least one display unit.

40. The display control apparatus of claim 39, wherein the adjusting the pixel distribution comprises:

controlling the at least one display unit to be deformed to cause at least one of the first quantity of pixels distributed along the first direction in each effective display region of the at least one display unit to be increased, or a second quantity of pixels distributed along the second direction to be reduced.

41. The display control apparatus of claim 33, wherein the increasing each effective display region of the at least one display unit comprises:

at least adjusting at least one optical parameter of at least one lens corresponding to the at least one display unit to cause each effective display region of the at least one display unit to be increased.

42. The display control apparatus of claim 33, wherein the increasing each effective display region of the at least one display unit comprises:

at least moving at least one lens corresponding to the at least one display unit along an optical axis direction of the at least one display unit to cause each effective display region of the at least one display unit to be increased.

43. The display control apparatus of claim 33, wherein the at least one display unit comprises a magnetic-induced deforming material part.

44. The display control apparatus of claim 33, wherein the determining the first direction according to a moving information of the display system comprises:

determining a reference direction, corresponding to the moving information of the display system, as the first direction according to a mapping relation between the moving information of the display system and the reference direction.

45. The display control apparatus of claim 33, wherein the changed display system comprises at least one changed display unit, and wherein the displaying the content to be displayed by the changed display system comprises:

performing sampling processing on the content according to pixel actual position information of the at least one changed display unit; and displaying the content after sampling processing by the changed display system.

46. The display control apparatus of claim 33, wherein the changed display system comprises at least one changed display unit, and wherein the displaying the content to be displayed by the changed display system comprises:

adjusting partial drive information of a corresponding part of the content according to pixel practical position information of the at least one changed display unit, resulting in changed drive information; and controlling the changed display system to display the content according to the changed drive information.

47. The display control apparatus of claim 33, wherein the at least one display unit comprises a controllable deforming material part.

48. The display control apparatus of claim 33, wherein the at least one display unit comprises an elastic part.

* * * * *